US010344781B2

(12) United States Patent
Kamoshita et al.

(10) Patent No.: US 10,344,781 B2
(45) Date of Patent: Jul. 9, 2019

(54) CONTROL SYSTEM, WORK MACHINE, AND CONTROL METHOD

(71) Applicant: Komatsu Ltd., Tokyo (JP)

(72) Inventors: Yuta Kamoshita, Hiratsuka (JP); Tadashi Kawaguchi, Hiratsuka (JP); Teruo Akiyama, Hiratsuka (JP); Kenji Oshima, Hiratsuka (JP); Koji Saito, Hiratsuka (JP); Noboru Iida, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 145 days.

(21) Appl. No.: 15/501,269

(22) PCT Filed: Jul. 29, 2016

(86) PCT No.: PCT/JP2016/072447

§ 371 (c)(1),
(2) Date: Feb. 2, 2017

(87) PCT Pub. No.: WO2018/020689

PCT Pub. Date: Feb. 1, 2018

(65) Prior Publication Data

US 2018/0216637 A1 Aug. 2, 2018

(51) Int. Cl.
*F15B 13/06* (2006.01)
*F15B 11/02* (2006.01)
(Continued)

(52) U.S. Cl.
CPC ..... *F15B 13/06* (2013.01); *E02F 3/34* (2013.01); *E02F 9/2242* (2013.01);
(Continued)

(58) Field of Classification Search
CPC ..... F15B 11/162; F15B 11/17; F15B 13/06; F15B 2211/20576; F15B 2211/50554; F15B 2211/781; E02F 9/2242
See application file for complete search history.

(56) References Cited

U.S. PATENT DOCUMENTS 7,520,130 B2 * 4/2009 Tanaka ..... F15B 11/17 60/421
7,562,472 B2 * 7/2009 Tozawa ..... E02F 9/2075 37/348

(Continued)

FOREIGN PATENT DOCUMENTS

CN 2923463 Y 7/2007
CN 102985703 A 3/2013

(Continued)

OTHER PUBLICATIONS

International Search Report dated Oct. 25, 2016, issued for PCT/JP2016/072447.

*Primary Examiner* — Thomas E Lazo
(74) *Attorney, Agent, or Firm* — Locke Lord LLP

(57) ABSTRACT

A control system for controlling a work machine including a working unit including elements and actuators that drives the elements includes: a first hydraulic pump and a second hydraulic pump each of which supplies operating oil to at least one of the actuators; and a control device that calculates a distribution flow rate of operating oil distributed to each of the actuators based on an operating state of the working unit and switches, based on the calculated distribution flow rate, between a first state in which the operating oil supplied from both the first hydraulic pump and the second hydraulic pump is supplied to the actuators and a second state in which the actuator to which the operating oil is supplied from the first hydraulic pump is different from the actuator to which the operating oil is supplied from the second hydraulic pump.

10 Claims, 9 Drawing Sheets

(51) Int. Cl.

| | |
|---|---|
| ***E02F 3/34*** | (2006.01) |
| ***E02F 9/22*** | (2006.01) |
| ***F15B 11/05*** | (2006.01) |
| ***F15B 11/16*** | (2006.01) |
| ***F15B 11/17*** | (2006.01) |

(52) U.S. Cl.
CPC ..... *E02F 9/2267* (2013.01); *E02F 9/2296* (2013.01); *F15B 11/02* (2013.01); *F15B 11/055* (2013.01); *F15B 11/162* (2013.01); *F15B 11/17* (2013.01); *F15B 2211/20576* (2013.01); *F15B 2211/4053* (2013.01); *F15B 2211/50554* (2013.01); *F15B 2211/781* (2013.01)

(56) References Cited

U.S. PATENT DOCUMENTS

| | | | | |
|---|---|---|---|---|
| 7,992,384 | B2 * | 8/2011 | Itakura | E02F 9/2228 60/421 |
| 8,650,778 | B2 * | 2/2014 | Okano | E02F 9/2239 172/3 |
| 8,756,930 | B2 * | 6/2014 | Johnson | B62D 5/075 60/430 |
| 9,145,660 | B2 * | 9/2015 | Peterson | E02F 9/2235 |
| 2007/0125078 | A1 | 6/2007 | Tanaka et al. | |
| 2009/0056324 | A1 | 3/2009 | Itakura et al. | |
| 2009/0057040 | A1 | 3/2009 | Yamada et al. | |
| 2011/0289908 | A1 | 12/2011 | Johnson et al. | |
| 2014/0090369 | A1 * | 4/2014 | Nakamura | E02F 9/2242 60/459 |
| 2014/0283676 | A1 * | 9/2014 | Beschorner | F15B 11/17 91/418 |
| 2014/0283915 | A1 * | 9/2014 | Ma | F15B 1/027 137/1 |

FOREIGN PATENT DOCUMENTS

| | | | |
|---|---|---|---|
| CN | 203353185 | U | 12/2013 |
| CN | 104221593 | A | 12/2014 |
| CN | 104675768 | A | 6/2015 |
| CN | 105634971 | A | 6/2016 |
| JP | 2004-036681 | A | 2/2004 |
| JP | 4272207 | B2 | 6/2009 |
| JP | 2013-532260 | A | 8/2013 |
| KR | 10-2008-0016589 | A | 2/2008 |
| WO | 2006/123704 | A1 | 11/2006 |
| WO | 2007/132691 | A1 | 11/2007 |

* cited by examiner

CONTROL SYSTEM, WORK MACHINE, AND CONTROL METHOD

FIELD

The present invention relates to a control system for controlling a work machine, a work machine, and a control method.

BACKGROUND

A work machine including a working unit is known. For example, when the work machine is an excavator, the working unit has a bucket, an arm, and a boom. A hydraulic cylinder is used as an actuator for operating the working unit. A hydraulic pump that discharges operating oil is used as a drive source of the hydraulic cylinder. A work machine including a plurality of hydraulic pumps for driving the hydraulic cylinder is known. Patent Literature 1 discloses a hydraulic circuit including a merging valve that selectively merges or splits the operating oil discharged from a first hydraulic pump and the operating oil discharged from a second hydraulic pump.

CITATION LIST

Patent Literature

Patent Literature 1: WO 2006/123704

SUMMARY

Technical Problem

Examples of a hydraulic cylinder that drives a working unit include a hydraulic cylinder which requires high-pressure operating oil and a hydraulic cylinder which requires high flow-rate and low-pressure operating oil. When operating oils discharged from two hydraulic pumps are merged, since the pressure of the operating oil is set based on the hydraulic cylinder which requires high-pressure operating oil, it is necessary to decrease the pressure of the operating oil supplied to the hydraulic cylinder which requires a high flow rate. When the pressure of the operating oil is decreased, a pressure loss occurs. Therefore, it is desirable to split the operating oils discharged from the two hydraulic pumps, supply operating oil from one hydraulic pump to a hydraulic cylinder which requires high-pressure operating oil, and supply operating oil from the other hydraulic pump to a hydraulic cylinder which requires high flow-rate operating oil.

An object of some aspects of the present invention is to extend a period in which, when operating oil is supplied from a plurality of hydraulic pumps to an actuator, the operating oils discharged from the plurality of hydraulic pumps can be split and supplied to the actuator.

Solution to Problem

According to a first aspect of the present invention, a control system for controlling a work machine including a working unit including a plurality of elements and a plurality of actuators that drives the plurality of elements, comprises: a first hydraulic pump and a second hydraulic pump each of which supplies operating oil to at least one of the actuators; and a control device that calculates a distribution flow rate of operating oil distributed to each of the actuators based on an operating state of the working unit and switches, based on the calculated distribution flow rate, between a first state in which the operating oil supplied from both the first hydraulic pump and the second hydraulic pump is supplied to the actuators and a second state in which the actuator to which the operating oil is supplied from the first hydraulic pump is different from the actuator to which the operating oil is supplied from the second hydraulic pump.

According to a second aspect of the present invention, in first aspect, the control device calculates the distribution flow rate based on the operating state of the working unit and a load of the actuator.

According to a third aspect of the present invention, the control system according to first or second aspect, further comprises: a passage that connects the first hydraulic pump and the second hydraulic pump; and an opening and closing device that is provided in the passage to open and close the passage, wherein in a state in which the passage is closed, the first hydraulic pump supplies operating oil to a first actuator group to which at least one of the actuators belongs, and the second hydraulic pump supplies operating oil to a second actuator group to which at least one of the actuators different from the actuator belonging to the first actuator group belongs, and the control device switches between the first state and the second state by operating the opening and closing device based on the distribution flow rate.

According to a fourth aspect of the present invention, in third aspect, the control device operates the opening and closing device based on a comparison result between the distribution flow rate and a threshold determined based on a flow rate of operating oil that one first hydraulic pump can supply and a flow rate of operating oil that one second hydraulic pump can supply.

According to a fifth aspect of the present invention, in third or fourth aspect, when the calculated distribution flow rate increases with time, the control device operates the opening and closing device using a corrected distribution flow rate obtained by decreasing an increase over time in the calculated distribution flow rate.

According to a sixth aspect of the present invention, in fifth aspect, when determining whether the opening and closing device is to be operated, the control device switches whether the corrected distribution flow rate or the distribution flow rate is to be used depending on the operating state.

According to a seventh aspect of the present invention, in any one of third to sixth aspects, the plurality of elements includes a bucket, an arm connected to the bucket, and a boom connected to the arm, the plurality of actuators includes a bucket cylinder that operates the bucket, an arm cylinder that operates the arm, and a boom cylinder that operates the boom, and the bucket cylinder and the arm cylinder belong to the first actuator group, and the boom cylinder belongs to the second actuator group.

According to an eighth aspect of the present invention, in any one of third to seventh aspects, the work machine has a swing structure that supports the working unit, and the swing structure is driven by an actuator that does not belong to the first actuator group and the second actuator group.

According to a ninth aspect of the present invention, the control system according to any one of third to sixth aspects, further comprises: a first detector that detects a largest load pressure of the actuators that belong to the first actuator group; a first oil passage that guides the largest load pressure detected by the first detector to a first hydraulic pump control device that operates the first hydraulic pump; a second detector that detects a largest load pressure of the actuators that belong to the second actuator group; a second oil passage that guides the largest load pressure detected by the second detector to a second hydraulic pump control device that operates the second hydraulic pump; and a switching valve that switches between a connection and a disconnection of the first detector and the second detector and switches between a connection and a disconnection of the first oil passage and the second oil passage, wherein in an intermediate state between the connection and the disconnection, the switching valve connects the first detector and the first oil passage in a state in which no throttle is provided, connects the first detector and the second detector in a state in which a throttle is provided, and connects the first oil passage and the second oil passage in a state in which a throttle is provided.

According to a tenth aspect of the present invention, in ninth aspect, the control device holds the switching valve in the intermediate state after the control device switches the switching valve from the disconnection state to the intermediate state, when a pressure difference between a pressure of the operating oil discharged from the first hydraulic pump and a pressure of the operating oil discharged from the second hydraulic pump is equal to or smaller than a predetermined threshold, the control device stops holding the switching valve in the intermediate state and changes the switching valve to the connection state, and the control device opens the opening and closing device after the switching valve enters into the connection state.

According to an eleventh aspect of the present invention, a work machine comprises the control system according to any one of first to tenth aspects.

According to a twelfth aspect of the present invention, a control method of controlling a work machine including a first hydraulic pump and a second hydraulic pump each of which supplies operating oil to at least one of a plurality of actuators that drives a plurality of elements that form the working unit, comprises: calculating a distribution flow rate of the operating oil distributed to each of the actuators based on an operating state of the working unit; and switching, based on the calculated distribution flow rate, between a first state in which the operating oil supplied from both the first hydraulic pump and the second hydraulic pump is supplied to the actuators and a second state in which the actuator to which the operating oil is supplied from the first hydraulic pump is different from the actuator to which the operating oil is supplied from the second hydraulic pump.

According to the aspects of the present invention, it is possible to extend a period in which, when operating oil is supplied from a plurality of hydraulic pumps to an actuator, the operating oils discharged from the plurality of hydraulic pumps can be split and supplied to the actuator.

DESCRIPTION OF EMBODIMENTS

Modes (embodiments) for carrying out the present invention will be described in detail with reference to the drawings.

[Work Machine]

Figure 1:
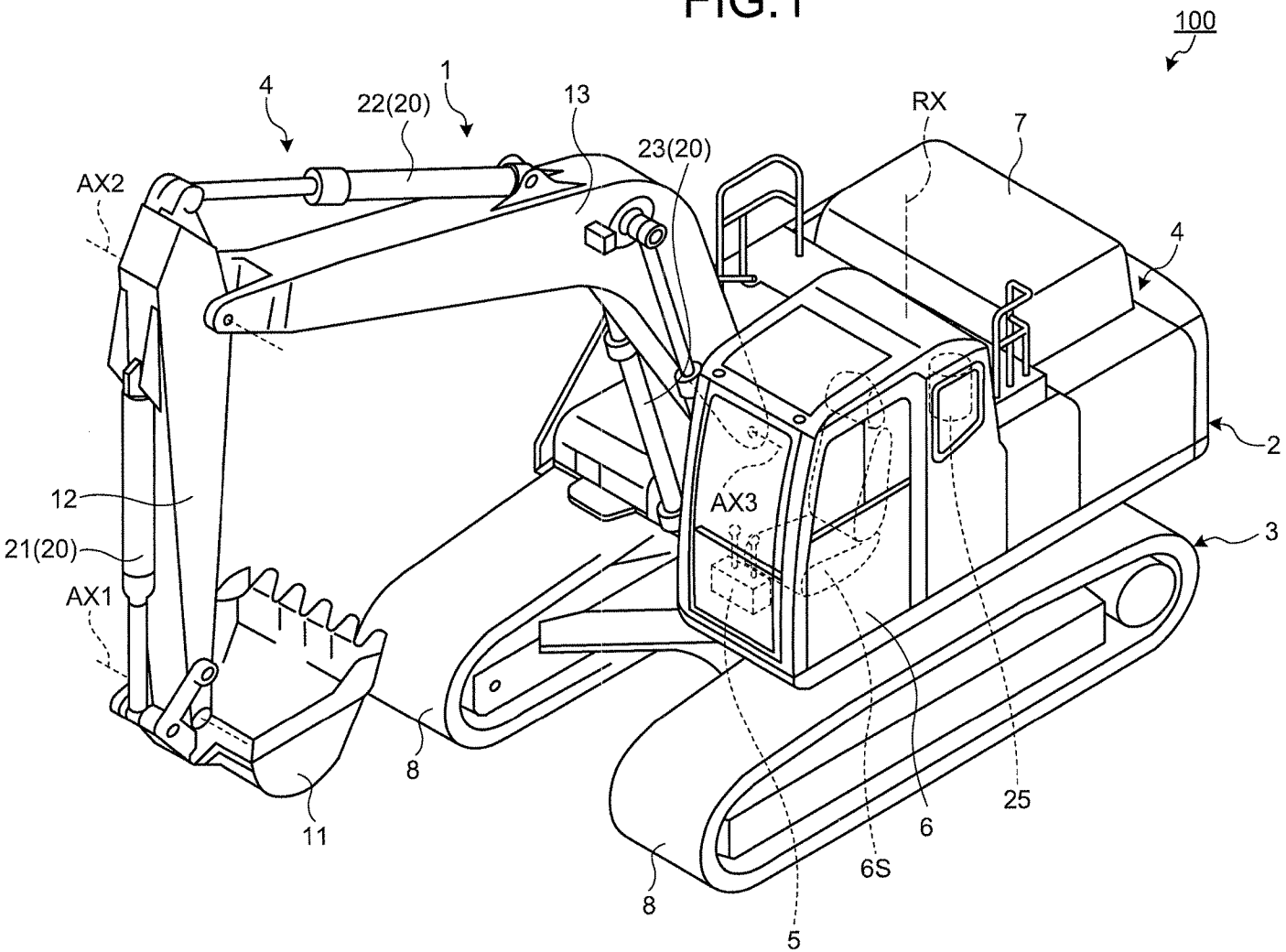
FIG. 1 is a perspective view illustrating an example of a work machine according to an embodiment.

FIG. 1 is a perspective view illustrating an example of a work machine 100 according to an embodiment. In the embodiment, an example in which the work machine 100 is a hybrid excavator will be described. In the following description, the work machine 100 is appropriately referred to as an excavator 100.

As illustrated in FIG. 1, the excavator 100 includes a working unit 1 that operates with hydraulic pressure, an upper swing structure 2 which is a swing structure that supports the working unit 1, a lower traveling structure 3 that supports the upper swing structure 2, a driving device 4 that drives the excavator 100, and an operating device 5 for operating the working unit 1.

The upper swing structure 2 has a cab 6 on which an operator boards and a machine room 7. A driver's seat 6S on which the operator sits is provided in the cab 6. The machine room 7 is disposed on a rear side of the cab 6. At least a portion of the driving device 4 including an engine, a hydraulic pump, and the like is disposed in the machine room 7. The lower traveling structure 3 has a pair of crawlers 8. The excavator 100 travels when the crawler 8 rotates. The lower traveling structure 3 may be wheels (tires).

The working unit 1 is supported on the upper swing structure 2. The working unit 1 includes a plurality of elements. The plurality of elements are structures that form the working unit. In the embodiment, the plurality of elements of the working unit 1 includes a bucket 11, an arm 12 connected to the bucket 11, and a boom 13 connected to the arm 12. The bucket 11 and the arm 12 are connected by a bucket pin. The bucket 11 is supported on the arm 12 so as to be rotatable about a rotation axis AX1. The arm 12 and the boom 13 are connected by an arm pin. The arm 12 is supported on the boom 13 so as to be rotatable about a rotation axis AX2. The boom 13 and the upper swing structure 2 are connected by a boom pin. The boom 13 is supported on the upper swing structure 2 so as to be rotatable about a rotation axis AX3. The upper swing structure 2 is supported on the lower traveling structure 3 so as to be rotatable about a swing axis RX.

The rotation axis AX3 is orthogonal to an axis parallel to the swing axis RX. In the following description, an axial direction of the rotation axis AX3 will be appropriately referred to as a vehicle width direction of the upper swing structure 2, and a direction orthogonal to both of the rotation axis AX3 and the swing axis RX will be appropriately referred to as a front-rear direction of the upper swing structure 2. A direction in which the working unit 1 is present about the swing axis RX is the front side. A direction in which the machine room 7 is present about the swing axis RX is the rear side.

The driving device 4 has a hydraulic cylinder 20 that operates the working unit 1 and an electric swing motor 25 that generates power for swinging the upper swing structure 2. The hydraulic cylinder 20 is driven with operating oil. The hydraulic cylinder 20 includes a bucket cylinder 21 that operates the bucket 11, an arm cylinder 22 that operates the arm 12, and a boom cylinder 23 that operates the boom 13. The upper swing structure 2 can swing about the swing axis RX with the power generated by the electric swing motor 25 in a state of being supported on the lower traveling structure 3.

The operating device 5 is disposed in the cab 6. The operating device 5 includes an operating member operated by the operator of the excavator 100. The operating member includes an operating lever or a joystick. The working unit 1 is operated when the operating device 5 is operated.

[Control System]

Figure 2:
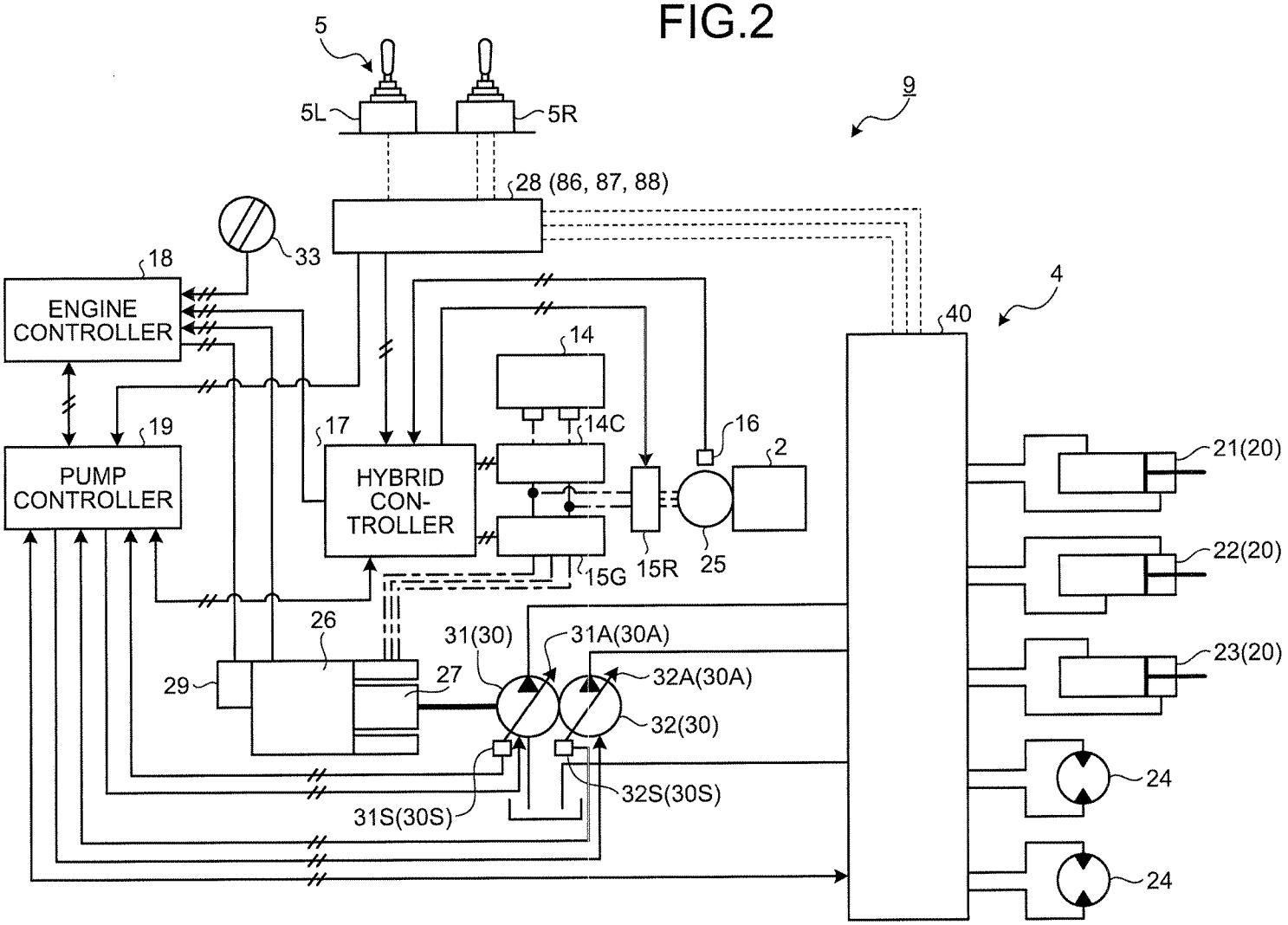
FIG. 2 is a diagram schematically illustrating a control system including a driving device of an excavator according to the embodiment.

FIG. 2 is a diagram schematically illustrating a control system 9 including the driving device 4 of the excavator 100 according to the embodiment. The control system 9 is a system for controlling the excavator 100 including the working unit 1 and a plurality of actuators for driving the working unit 1. The plurality of actuators is a plurality of hydraulic cylinders 20 (specifically, the bucket cylinder 21, the arm cylinder 22, and the boom cylinder 23). If working units 1 are different, the actuators are different. In the embodiment, the plurality of actuators that drive the working unit 1 are hydraulic actuators which are driven with operating oil. The plurality of actuators that drives the working unit 1 is not limited to the hydraulic cylinder 20 as long as the actuator is a hydraulic actuator. The plurality of actuators may be hydraulic motors, for example.

The driving device 4 has an engine 26 which is a drive source, a generator motor 27, and a hydraulic pump 30 that discharges operating oil. The engine 26 is a diesel engine, for example. The generator motor 27 is a switched reluctance motor, for example. The generator motor 27 may be a permanent magnet (PM) motor. The hydraulic pump 30 is a variable displacement hydraulic pump. In the embodiment, the hydraulic pump 30 is a swash plate-type hydraulic pump. The hydraulic pump 30 includes a first hydraulic pump 31 and a second hydraulic pump 32. An output shaft of the engine 26 is mechanically coupled to the generator motor 27 and the hydraulic pump 30. The generator motor 27 and the hydraulic pump 30 operate when the engine 26 is driven. The generator motor 27 may be mechanically connected directly to the output shaft of the engine 26 and may be connected to the output shaft of the engine 26 by a power transmission mechanism such as power take-off (PTO).

The driving device 4 includes a hydraulic drive system and an electric drive system. The hydraulic drive system has a hydraulic pump 30, a hydraulic circuit 40 in which the operating oil discharged from the hydraulic pump 30 flows, a hydraulic cylinder 20 that operates with the operating oil supplied via the hydraulic circuit 40, and a traveling motor 24. The traveling motor 24 is a hydraulic motor driven with the operating oil discharged from the hydraulic pump 30, for example.

The electric drive system has a generator motor 27, a storage battery 14, a transformer 14C, a first inverter 15G, a second inverter 15R, and an electric swing motor 25. When the engine 26 is driven, a rotor shaft of the generator motor 27 rotates. In this way, the generator motor 27 can generate electricity. The storage battery 14 is an electric double-layer storage battery, for example.

A hybrid controller 17 allows DC electric power to be exchanged between the transformer 14C and the first and second inverters 15G and 15R and allows DC electric power to be exchanged between the transformer 14C and the storage battery 14. The electric swing motor 25 operates based on the electric power supplied from the generator motor 27 or the storage battery 14 and generates power for swinging the upper swing structure 2. The electric swing motor 25 is an embedded magnet synchronous electric swing motor, for example. A rotation sensor 16 is provided in the electric swing motor 25. The rotation sensor 16 is a resolver or a rotary encoder, for example. The rotation sensor 16 detects a rotation angle or a rotation speed of the electric swing motor 25.

In the embodiment, the electric swing motor 25 generates regeneration energy during deceleration. The storage battery 14 is charged by the regeneration energy (electric energy) generated by the electric swing motor 25. The storage battery 14 may be a secondary battery such as a nickel-metal hydride battery or a lithium ion battery rather than the electric double-layer storage battery.

The driving device 4 operates based on an operation of the operating device 5 provided in the cab 6. An operation amount of the operating device 5 is detected by an operation amount detection unit 28. The operation amount detection unit 28 includes a pressure sensor. Pilot pressure generated according to the operation amount of the operating device 5 is detected by the operation amount detection unit 28. The operation amount detection unit 28 converts a detection signal of the pressure sensor to an operation amount of the operating device 5. The operation amount detection unit 28 may include an electric sensor like a potentiometer. When the operating device 5 includes an electric lever, an electric signal generated according to the operation amount of the operating device 5 is detected by the operation amount detection unit 28.

A throttle dial 33 is provided in the cab 6. The throttle dial 33 is an operating unit for setting the amount of fuel supplied to the engine 26.

The control system 9 includes the hybrid controller 17, an engine controller 18 that controls the engine 26, and a pump controller 19 that controls the hydraulic pump 30. The hybrid controller 17, the engine controller 18, and the pump controller 19 each include a computer system. The hybrid controller 17, the engine controller 18, and the pump controller 19 each include a processor such as a central processing unit (CPU), a storage device such as read only memory (ROM) or random access memory (RAM), and an input and output interface. The hybrid controller 17, the engine controller 18, and the pump controller 19 may be integrated into one controller.

The hybrid controller 17 adjusts the temperature of the generator motor 27, the electric swing motor 25, the storage battery 14, the first inverter 15G, and the second inverter 15R based on the detection signals of temperature sensors provided in the generator motor 27, the electric swing motor 25, the storage battery 14, the first inverter 15G, and the second inverter 15R. The hybrid controller 17 performs charge/discharge control of the storage battery 14, power generation control of the generator motor 27, and the assist control of the engine 26 by the generator motor 27. The hybrid controller 17 controls the electric swing motor 25 based on the detection signal of the rotation sensor 16.

The engine controller 18 generates a command signal based on the setting value of the throttle dial 33 and outputs the command signal to a common rail control unit 29 provided in the engine 26. The common rail control unit 29 adjusts the amount of fuel injected to the engine 26 based on the command signal transmitted from the engine controller 18.

The pump controller 19 generates a command signal for adjusting the flow rate of the operating oil discharged from the hydraulic pump 30 based on the command signal transmitted from at least one of the engine controller 18, the hybrid controller 17, and the operation amount detection unit 28. In the embodiment, the driving device 4 has two hydraulic pumps 30 (that is, a first hydraulic pump 31 and a second hydraulic pump 32). The first hydraulic pump 31 and the second hydraulic pump 32 are driven by the engine 26.

The pump controller 19 controls an inclination angle which is the inclination angle of a swash plate 30A of the hydraulic pump 30 to adjust the amount of the operating oil supplied from the hydraulic pump 30. A swash plate angle sensor 30S that detects a swash plate angle of the hydraulic pump 30 is provided in the hydraulic pump 30. The swash plate angle sensor 30S includes a swash plate angle sensor 31S that detects an inclination angle of a swash plate 31A of the first hydraulic pump 31 and a swash plate angle sensor 32S that detects an inclination angle of a swash plate 32A of the second hydraulic pump 32. The detection signal of the swash plate angle sensor 30S is output to the pump controller 19.

The pump controller 19 calculates a pump capacity (cc/rev) of the hydraulic pump 30 based on the detection signal of the swash plate angle sensor 30S. A servo mechanism that drives the swash plate 30A is provided in the hydraulic pump 30. The pump controller 19 controls the servo mechanism to adjust the swash plate angle. A pump pressure sensor for detecting a pump discharge pressure of the hydraulic pump 30 is provided in the hydraulic circuit 40. The detection signal of the pump pressure sensor is output to the pump controller 19. In the embodiment, the engine controller 18 and the pump controller 19 are connected to an in-vehicle local area network (LAN) like a controller area network (CAN). With the in-vehicle LAN, the engine controller 18 and the pump controller 19 can exchange data. The pump controller 19 acquires detection values of the respective sensors provided in the hydraulic circuit 40 and outputs a control command for controlling the hydraulic pump 30 and the like. The details of the control executed by the pump controller 19 will be described later.

[Hydraulic Circuit 40]

Figure 3:
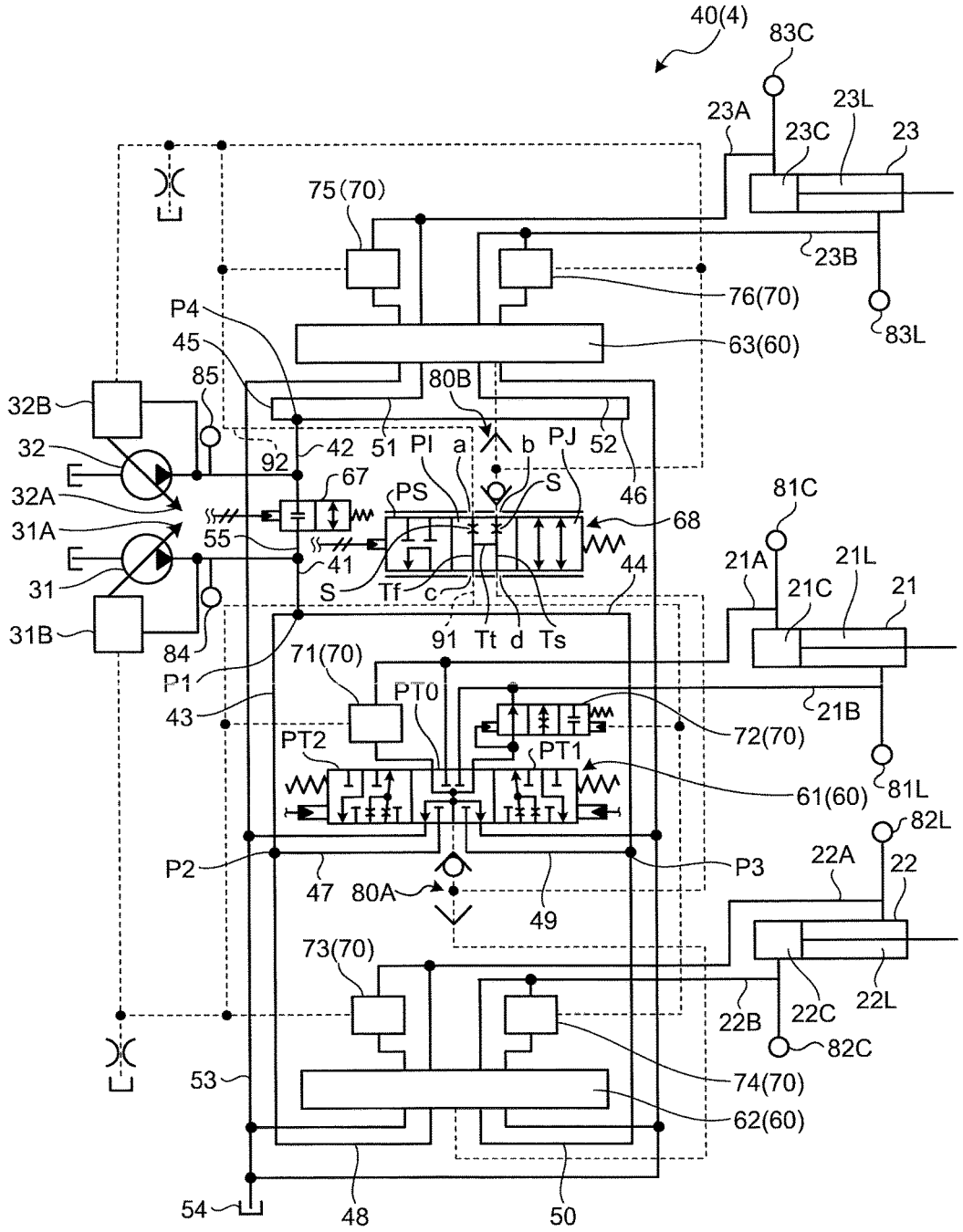
FIG. 3 is a diagram illustrating a hydraulic circuit of the driving device according to the embodiment.

FIG. 3 is a diagram illustrating the hydraulic circuit 40 of the driving device 4 according to the embodiment. The driving device 4 includes the bucket cylinder 21, the arm cylinder 22, the boom cylinder 23, the first hydraulic pump 31 that discharges operating oil to be supplied to the bucket cylinder 21 and the arm cylinder 22, and a second hydraulic pump 32 that discharges operating oil to be supplied to the boom cylinder 23.

The hydraulic circuit 40 includes a first pump passage 41 connected to the first hydraulic pump 31 and a second pump passage 42 connected to the second hydraulic pump 32. The hydraulic circuit 40 includes a first supply passage 43 and a second supply passage 44 connected to the first pump passage 41 and a third supply passage 45 and a fourth supply passage 46 connected to the second pump passage 42.

The first pump passage 41 branches into the first supply passage 43 and the second supply passage 44 in a first branch portion P1. The second pump passage 42 branches into the third supply passage 45 and the fourth supply passage 46 in a fourth branch portion P4.

The hydraulic circuit 40 includes a first branch passage 47 and a second branch passage 48 connected to the first supply passage 43 and a third branch passage 49 and a fourth branch passage 50 connected to the second supply passage 44. The first supply passage 43 branches into the first branch passage 47 and the second branch passage 48 in a second branch portion P2. The second supply passage 44 branches into the third branch passage 49 and the fourth branch passage 50 in a third branch portion P3. The hydraulic circuit 40 includes a fifth branch passage 51 connected to the third supply passage 45 and a sixth branch passage 52 connected to the fourth supply passage 46.

The hydraulic circuit 40 includes a first main operating valve 61 connected to the first branch passage 47 and the third branch passage 49, a second main operating valve 62 connected to the second branch passage 48 and the fourth branch passage 50, and a third main operating valve 63 connected to the fifth branch passage 51 and the sixth branch passage 52.

The hydraulic circuit 40 includes a first bucket passage 21A that connects a first main operating valve 61 and a cap-side space 21C of the bucket cylinder 21 and a second bucket passage 21B that connects the first main operating valve 61 and a rod-side space 21L of the bucket cylinder 21. The hydraulic circuit 40 includes a first arm passage 22A that connects a second main operating valve 62 and a rod-side space 22L of the arm cylinder 22 and a second arm passage 22B that connects the second main operating valve 62 and a cap-side space 22C of the arm cylinder 22. The hydraulic circuit 40 includes a first boom passage 23A that connects a third main operating valve 63 and a cap-side space 23C of the boom cylinder 23 and a second boom passage 23B that connects the third main operating valve 63 and a rod-side space 23L of the boom cylinder 23.

The cap-side space of the hydraulic cylinder 20 is a space between a cylinder head cover and a piston. The rod-side space of the hydraulic cylinder 20 is a space in which a piston rod is disposed. When operating oil is supplied to the cap-side space 21C of the bucket cylinder 21 and the bucket cylinder 21 is extended, the bucket 11 performs an excavation operation. When operating oil is supplied to the rod-side space 21L of the bucket cylinder 21 and the bucket cylinder 21 is retracted, the bucket 11 performs a dumping operation.

When operating oil is supplied to the cap-side space 22C of the arm cylinder 22 and the arm cylinder 22 is extended, the arm 12 performs an excavation operation. When operating oil is supplied to the rod-side space 22L of the arm cylinder 22 and the arm cylinder 22 is retracted, the arm 12 performs a dumping operation.

When operating oil is supplied to the cap-side space 23C of the boom cylinder 23 and the boom cylinder 23 is extended, the boom 13 performs a raising operation. When operating oil is supplied to the rod-side space 23L of the boom cylinder 23 and the boom cylinder 23 is retracted, the boom 13 performs a lowering operation.

The working unit 1 operates with an operation of the operating device 5. In the embodiment, the operating device 5 includes a right operating lever 5R disposed on the right side of the operator sitting on the driver's seat 6S and a left operating lever 5L disposed on the left side. When the right operating lever 5R is operated in a front-rear direction, the boom 13 performs a lowering operation or a raising operation. When the right operating lever 5R is operated in a left-right direction (the vehicle width direction), the bucket 11 performs an excavation operation or a dumping operation. When the left operating lever 5L is operated in a front-rear direction, the arm 12 performs a dumping operation or an excavation operation. When the left operating lever 5L is operated in a left-right direction, the upper swing structure 2 swings toward the left side or the right side. The upper swing structure 2 may swing toward the right side or the left side when the left operating lever 5L is operated in the front-rear direction and the arm 12 may perform a dumping operation or an excavation operation when the left operating lever 5L is operated in the left-right direction.

The swash plate 31A of the first hydraulic pump 31 is driven by a servo mechanism 31B. The servo mechanism 31B operates based on the command signal from the pump controller 19 to adjust the inclination angle of the swash plate 31A of the first hydraulic pump 31. When the inclination angle of the swash plate 31A of the first hydraulic pump 31 is adjusted, the pump capacity (cc/rev) of the first hydraulic pump 31 is adjusted. Similarly, the swash plate 32A of the second hydraulic pump 32 is driven by a servo mechanism 32B. When the inclination angle of the swash plate 32A of the second hydraulic pump 32 is adjusted, the pump capacity (cc/rev) of the second hydraulic pump 32 is adjusted.

The first main operating valve 61 is a direction control valve that adjusts the direction and the flow rate of the operating oil supplied from the first hydraulic pump 31 to the bucket cylinder 21. The second main operating valve 62 is a direction control valve that adjusts the direction and the flow rate of the operating oil supplied from the first hydraulic pump 31 to the arm cylinder 22. The third main operating valve 63 is a direction control valve that adjusts the direction and the flow rate of the operating oil supplied from the second hydraulic pump 32 to the boom cylinder 23.

The first main operating valve 61 is a slide spool-type direction control valve. The spool of the first main operating valve 61 can move between a stop position PTO at which the supply of operating oil to the bucket cylinder 21 is stopped to stop the bucket cylinder 21, a first position PT1 at which the first branch passage 47 and the first bucket passage 21A are connected so that operating oil is supplied to the cap-side space 21C to extend the bucket cylinder 21, and a second position PT2 at which the third branch passage 49 and the second bucket passage 21B are connected so that operating oil is supplied to the rod-side space 21L to retract the bucket cylinder 21. The first main operating valve 61 is operated so that the bucket cylinder 21 enters into at least one of the stopped state, the extended state, and the retracted state.

The second main operating valve 62 has a structure equivalent to that of the first main operating valve 61. The spool of the second main operating valve 62 can move between a stop position at which the supply of operating oil to the arm cylinder 22 is stopped to stop the arm cylinder 22, a second position at which the fourth branch passage 50 and the second arm passage 22B are connected so that operating oil is supplied to the cap-side space 22C to extend the arm cylinder 22, and a first position at which the second branch passage 48 and the first arm passage 22A are connected so that operating oil is supplied to the rod-side space 22L to retract the arm cylinder 22. The second main operating valve 62 is operated so that the arm cylinder 22 enters into at least one of the stopped state, the extended state, and the retracted state.

The third main operating valve 63 has a structure equivalent to that of the first main operating valve 61. The spool of the third main operating valve 63 can move between a stop position at which the supply of operating oil to the boom cylinder 23 is stopped to stop the boom cylinder 23, a first position at which the fifth branch passage 51 and the first boom passage 23A are connected so that operating oil is supplied to the cap-side space 23C to extend the boom cylinder 23, and a second position at which the sixth branch passage 52 and the second boom passage 23B are connected so that operating oil is supplied to the rod-side space 23L to retract the boom cylinder 23. The third main operating valve 63 is operated so that the boom cylinder 23 enters into at least one of the stopped state, the extended state, and the retracted state.

The first main operating valve 61 is operated by the operating device 5. When the operating device 5 is operated, the pilot pressure acts on the first main operating valve 61, and the direction and the flow rate of the operating oil supplied from the first main operating valve 61 to the bucket cylinder 21 are determined. The bucket cylinder 21 operates in a moving direction corresponding to the direction of the operating oil supplied to the bucket cylinder 21, and the bucket cylinder 21 operates at a cylinder speed corresponding to the flow rate of the operating oil supplied to the bucket cylinder 21.

Similarly, the second main operating valve 62 is operated by the operating device 5. When the operating device 5 is operated, the direction and the flow rate of the operating oil supplied from the second main operating valve 62 to the arm cylinder 22 are determined. The arm cylinder 22 operates in a moving direction corresponding to the direction of the operating oil supplied to the arm cylinder 22, and the arm cylinder 22 operates in a cylinder speed corresponding to the flow rate of the operating oil supplied to the arm cylinder 22.

Similarly, the third main operating valve 63 is operated by the operating device 5. When the operating device 5 is operated, the direction and the flow rate of the operating oil supplied from the third main operating valve 63 to the boom cylinder 23 are determined. The boom cylinder 23 operates in a moving direction corresponding to the direction of the operating oil supplied to the boom cylinder 23, and the boom cylinder 23 operates at a cylinder speed corresponding to the flow rate of the operating oil supplied to the boom cylinder 23.

When the bucket cylinder 21 operates, the bucket 11 is driven based on the moving direction and the cylinder speed of the bucket cylinder 21. When the arm cylinder 22 operates, the arm 12 is driven based on the moving direction and the cylinder speed of the arm cylinder 22. When the boom cylinder 23 operates, the boom 13 is driven based on the moving direction and the cylinder speed of the boom cylinder 23.

The operating oils discharged from the bucket cylinder 21, the arm cylinder 22, and the boom cylinder 23 are discharged to a tank 54 via a discharge passage 53.

The first pump passage 41 and the second pump passage 42 are connected by a merging passage 55. The merging passage 55 is a passage that connects the first hydraulic pump 31 and the second hydraulic pump 32. Specifically, the merging passage 55 connects the first hydraulic pump 31 and the second hydraulic pump 32 via the first pump passage 41 and the second pump passage 42.

A first merging and splitting valve is provided in the merging passage 55. A first merging and splitting valve 67 is an opening and closing device that is provided in the merging passage 55 so as to open and close the merging passage 55. The first merging and splitting valve 67 opens and closes the merging passage 55 to switch between a merging state in which the first pump passage 41 and the second pump passage 42 are connected and a splitting state in which the first pump passage 41 and the second pump passage 42 are split. In the embodiment, although a switching valve is used as the first merging and splitting valve 67, the merging and splitting valve is not limited to this.

The merging state means a state in which the first pump passage 41 and the second pump passage 42 are connected by the merging passage 55 and the operating oil discharged from the first pump passage 41 and the operating oil discharged from the second pump passage 42 merge together in the merging and splitting valve. The merging state is a first state in which the operating oils supplied from both the first hydraulic pump 31 and the second hydraulic pump 32 are supplied to a plurality of actuators (that is, the bucket cylinder 21, the arm cylinder 22, and the boom cylinder 23).

The splitting state means a state in which the merging passage 55 that connects the first pump passage 41 and the second pump passage 42 is split by the merging and splitting valve and the operating oil discharged from the first pump passage 41 and the operating oil discharged from the second pump passage 42 are split. The splitting state is a second state in which an actuator to which operating oil is supplied from the first hydraulic pump 31 is different from an actuator to which operating oil is supplied from the second hydraulic pump 32. In the embodiment, in the splitting state, the operating oil is supplied from the first hydraulic pump 31 to the bucket cylinder 21 and the arm cylinder 22 and the operating oil is supplied from the second hydraulic pump 32 to the boom cylinder 23.

The spool of the first merging and splitting valve 67 can move between a merging position at which the merging passage 55 is open to connect the first pump passage 41 and the second pump passage 42 and a splitting position at which the merging passage 55 is closed to split the first pump passage 41 and the second pump passage 42. The first merging and splitting valve 67 is controlled so that the first pump passage 41 and the second pump passage 42 enter into at least one of the merging state and the splitting state.

When the first merging and splitting valve 67 is closed, the merging passage 55 is closed. In a closed state of the merging passage 55, the first hydraulic pump 31 supplies operating oil to a first actuator group to which at least one actuator belongs and the second hydraulic pump 32 supplies operating oil to a second actuator group to which at least one actuator different from the actuator belonging to the first actuator group belongs. In the embodiment, the bucket cylinder 21 and the arm cylinder 22 among the bucket cylinder 21, the arm cylinder 22, and the boom cylinder 23 belong to the first actuator group. The boom cylinder 23 among the bucket cylinder 21, the arm cylinder 22, and the boom cylinder 23 belongs to the second actuator group.

When the first merging and splitting valve 67 is closed and the merging passage 55 is closed, the operating oil discharged from the first hydraulic pump 31 is supplied to the bucket cylinder 21 and the arm cylinder 22 via the first pump passage 41, the first main operating valve 61, and the second main operating valve 62. Moreover, the operating oil discharged from the second hydraulic pump 32 is supplied to the boom cylinder 23 via the second pump passage 42 and the third main operating valve 63.

When the first merging and splitting valve 67 is open and the merging passage 55 is open, the first pump passage 41 and the second pump passage 42 are connected. As a result, the operating oil discharged from the first hydraulic pump 31 and the second hydraulic pump 32 is supplied to the bucket cylinder 21, the arm cylinder 22, and the boom cylinder 23 via the first pump passage 41, the second pump passage 42, the first main operating valve 61, the second main operating valve 62, and the third main operating valve 63.

The first merging and splitting valve 67 is controlled by the pump controller 19. In the embodiment, the pump controller 19 is a control device that calculates a distribution flow rate of the operating oil distributed to the respective hydraulic cylinders 20 based on the operating state of the working unit 1 and the load of the hydraulic cylinder 20 and operates the first merging and splitting valve 67 based on the calculated distribution flow rate. The details of the pump controller 19 will be described later.

[Second Merging and Splitting Valve 68]

The hydraulic circuit 40 has a second merging and splitting valve 68 which is a switching valve. The second merging and splitting valve 68 is connected to a first shuttle valve 80A provided between the first main operating valve 61 and the second main operating valve 62. The largest pressure of the first main operating valve 61 and the second main operating valve 62 is selected by the first shuttle valve 80A and is output to the second merging and splitting valve 68. Moreover, a second shuttle valve 80B is connected between the second merging and splitting valve 68 and the third main operating valve 63. The first shuttle valve 80A is connected to a connection port d of the second merging and splitting valve 68 and the second shuttle valve is connected to a connection port b of the second merging and splitting valve 68.

A first oil passage 91 is connected to a connection port c of the second merging and splitting valve 68 and a second oil passage 92 is connected to a connection port a. The first oil passage 91 is connected to pressure compensation valves 71 and 72 of the bucket cylinder 21, pressure compensation valves 73 and 74 of the arm cylinder 22, and the servo mechanism 31B of the first hydraulic pump 31. The second oil passage 92 is connected to pressure compensation valves 75 and 76 of the boom cylinder 23 and the servo mechanism 32B of the second hydraulic pump 32. The servo mechanism 31B is a first hydraulic pump control device that operates the first hydraulic pump 31. The servo mechanism 32B is a second hydraulic pump control device that operates the second hydraulic pump 32.

The second merging and splitting valve 68 selects a largest pressure of the load sensing pressure (LS pressure), at which the operating oil supplied to the respective shafts of the bucket cylinder 21 (first shaft), the arm cylinder 22 (second shaft), and the boom cylinder 23 (third shaft) is decompressed, with the aid of the first shuttle valve 80A and the second shuttle valve 80B. The load sensing pressure is a pilot pressure used for pressure compensation.

The second merging and splitting valve 68 switches the first shuttle valve 80A and the second shuttle valve 80B between the merging position PJ and the splitting position PS and switches the first oil passage 91 and the second oil passage 92 between the merging position PJ and the splitting position PS. The second merging and splitting valve 68 switches between the merging position PJ and the splitting position PS with an intermediate position PI interposed. The second merging and splitting valve 68 is controlled by the pump controller 19.

In the intermediate position PI, a throttle S is provided in a passage Tf that connects the connection port a and the connection port b and a passage Ts that connects the connection port c and the connection port d. Moreover, in the intermediate position PI, the throttle S is not provided in a passage Tt that connects the passage Tf and the passage Ts. That is, the cross-sectional area of the passage Tf and the passage Ts is larger than the cross-sectional area of the passage Tt. With such a structure, the second merging and splitting valve 68 realizes a connection state (that is, a fully open state) at the merging position PJ, a blocked state (that is, a fully closed state) at the splitting position PS, and an intermediate state (that is, an intermediate open state) at the intermediate position PI.

When the second merging and splitting valve 68 is at the merging position PJ, the first shuttle valve 80A and the second shuttle valve 80B are connected and the first oil passage 91 and the second oil passage 92 are connected. When the second merging and splitting valve 68 is at the splitting position PS, the first shuttle valve 80A and the second shuttle valve 80B are blocked and the first oil passage 91 and the second oil passage 92 are blocked. In this case, the first shuttle valve 80A and the first oil passage 91 are connected and the second shuttle valve 80B and the second oil passage 92 are blocked.

When the second merging and splitting valve 68 is at the intermediate position PI, the first shuttle valve 80A and the second shuttle valve 80B are connected with the throttle S provided therebetween and the first oil passage 91 and the second oil passage 92 are connected with the throttle S provided therebetween. At the intermediate position PI, the first shuttle valve 80A and the first oil passage 91 are connected without the throttle S provided therebetween.

When the second merging and splitting valve 68 is at the merging position PJ (that is, the merging state), the largest LS pressure of the first to third shafts is selected. The selected largest LS pressure is supplied to the pressure compensation valve 70, the servo mechanism 31B of the first hydraulic pump 31, and the servo mechanism 32B of the second hydraulic pump 32 of each of the first to third shafts. When the second merging and splitting valve 68 is at the splitting position PS (that is, the splitting state), the largest LS pressure of the first and second shafts is supplied to the pressure compensation valve 70 and the servo mechanism 31B of the first hydraulic pump 31 of each of the first and second shafts and the LS pressure of the third shaft is supplied to the pressure compensation valve 70 and the servo mechanism 32B of the second hydraulic pump 32 of the third shaft.

When the second merging and splitting valve 68 is at the merging position PJ, the first shuttle valve 80A and the second shuttle valve 80B detect a pilot pressure having the largest value among the pilot pressures output from the first main operating valve 61, the second main operating valve 62, and the third main operating valve 63. The detected pilot pressure is guided to the pressure compensation valve 70 and the servo mechanism (31B, 32B) of the hydraulic pump 30 (31, 32) via the first oil passage 91 and the second oil passage 93. Specifically, the pilot pressure having the largest value is guided to the pressure compensation valve 70 of the hydraulic cylinder 20 belonging to the first actuator group by the first oil passage 91 and is guided to the pressure compensation valve 70 of the hydraulic cylinder 20 belonging to the second actuator group by the second oil passage 92.

When the second merging and splitting valve 68 is at the splitting position PS, the first shuttle valve 80A detects a pilot pressure having a largest value among the pilot pressures output from the first main operating valve 61 and the second main operating valve 62. The detected pilot pressure is guided to the pressure compensation valves 71, 72, 73, and 74 and the servo mechanism 31B of the first hydraulic pump 31 by the first oil passage 91. Moreover, when the second merging and splitting valve 68 is at the splitting position PS, the second shuttle valve 80B detects the pilot pressure output from the third main operating valve 63. The detected pilot pressure is guided to the pressure compensation valves 75 and 76 and the servo mechanism 32B of the second hydraulic pump 32 by the second oil passage 92.

When the second merging and splitting valve 68 is at the merging position PJ, the first shuttle valve 80A and the second shuttle valve 80B select a pilot pressure having a largest value among the pilot pressures output from main operating valves 60 of the plurality of actuators belonging to the first actuator group and the second actuator group. The selected pilot pressure is supplied to the plurality of pressure compensation valves 70 belonging to the first actuator group and the second actuator group and the servo mechanism (31B, 32B) of the hydraulic pump 30 (31, 32). When the second merging and splitting valve 68 is at the splitting position PS, the first shuttle valve 80A selects a pilot pressure having a largest value among the pilot pressures output from the main operating valves 60 of the plurality of hydraulic cylinders 20 belonging to the first actuator group. The selected pilot pressure is supplied to the plurality of pressure compensation valves 70 belonging to the second actuator group and the servo mechanism 31B of the first hydraulic pump 31. Moreover, when the second merging and splitting valve 68 is at the splitting position PS, the second shuttle valve 80B selects the pilot pressure output from the main operating valve 60 of at least one actuator belonging to the second actuator group. The selected pilot pressure is supplied to the pressure compensation valve 70 belonging to the second actuator group and the servo mechanism 32B of the second hydraulic pump 32.

The pilot pressure output from the first main operating valve 61 and the second main operating valve 62 is a load pressure of an actuator (that is, the hydraulic cylinder 20) belonging to the first actuator group. The pilot pressure output from the third main operating valve 63 is a load pressure of an actuator (that is, the hydraulic cylinder 20) of belonging to the second actuator group. The first shuttle valve 80A is a first detector that detects a largest load pressure of the actuators belonging to the first actuator group. The second shuttle valve 80B is a second detector that detects a largest load pressure of the actuators belonging to the second actuator group.

Figure 4:
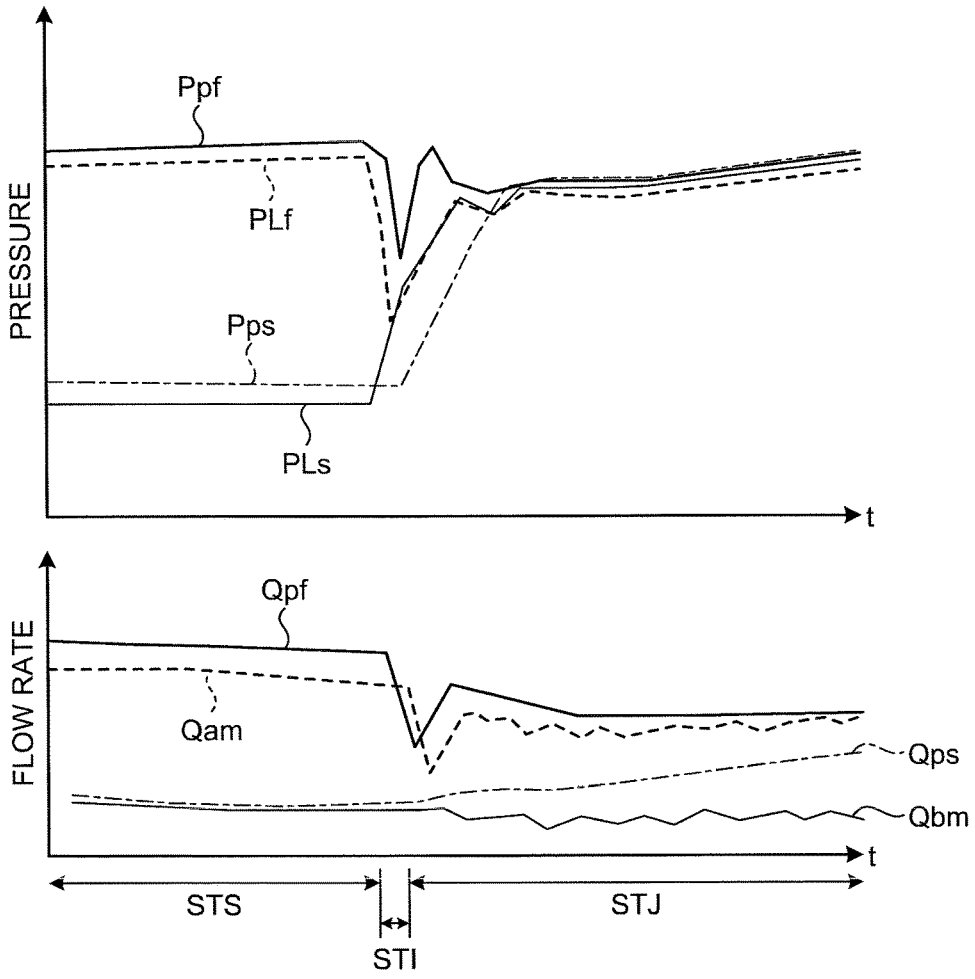
FIG. 4 is a diagram illustrating an example in which a discharge pressure and a largest LS pressure of a hydraulic pump and the flow rates of the hydraulic pump and a hydraulic cylinder change with time.
Figure 5:
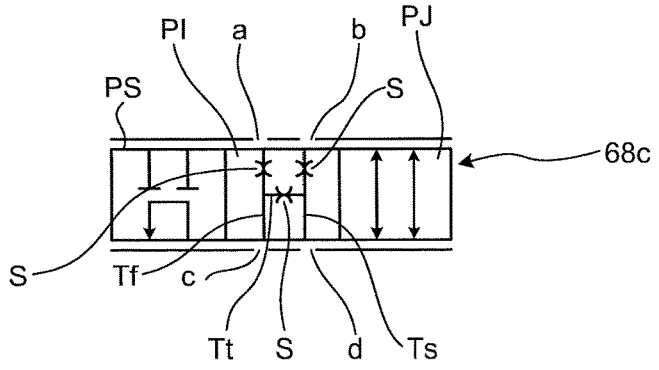
FIG. 5 is a diagram illustrating a second merging and splitting valve 68*c* according to a comparative example.
Figure 6:
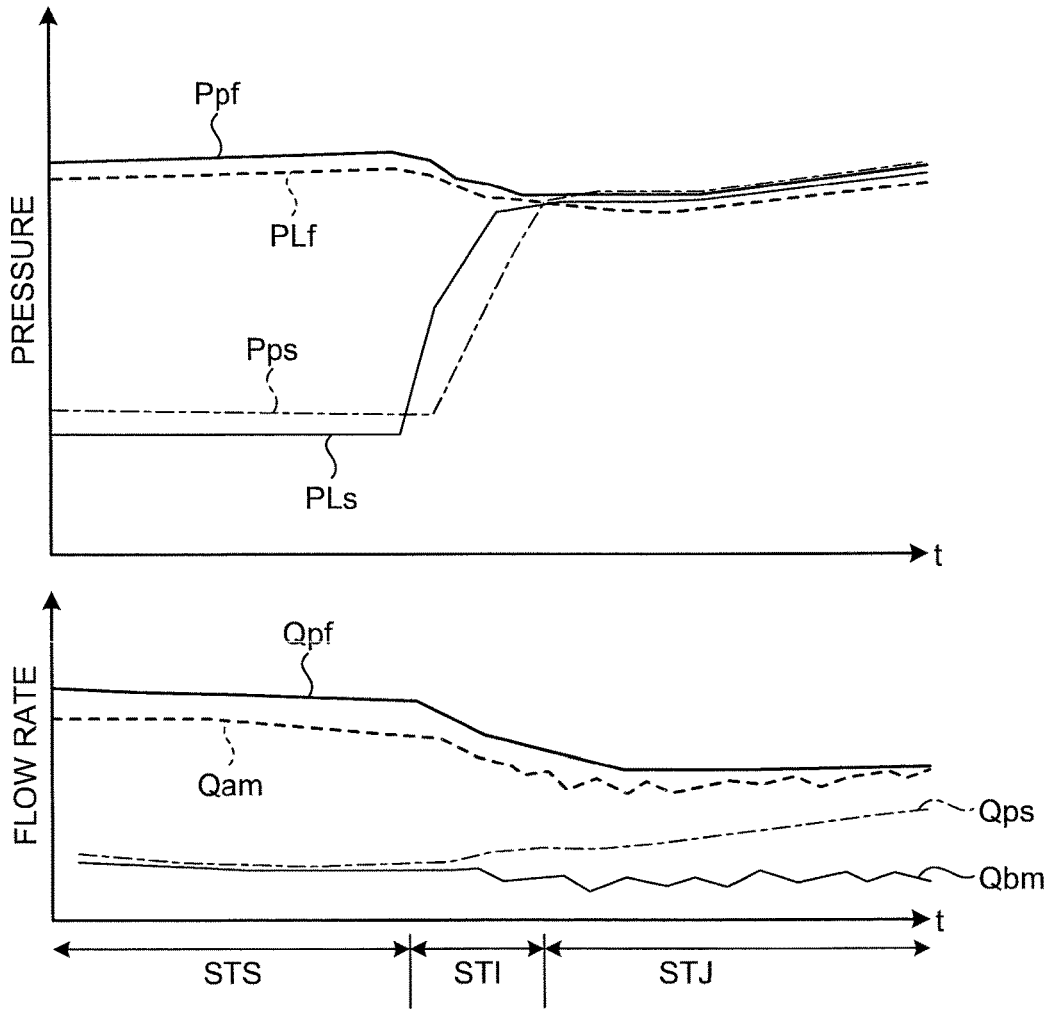
FIG. 6 is a diagram illustrating an example in which a discharge pressure and a largest LS pressure of a hydraulic pump and the flow rates of the hydraulic pump and a hydraulic cylinder change with time in the embodiment.

FIG. 4 is a diagram illustrating an example in which the discharge pressure and the largest LS pressure of a hydraulic pump and the flow rates of the hydraulic pump and the hydraulic cylinder change with time t in a comparative example. FIG. 5 is a diagram illustrating a second merging and splitting valve 68*c* according to the comparative example. FIG. 6 is a diagram illustrating an example in which the discharge pressure and the largest LS pressure of a hydraulic pump and the flow rates of the hydraulic pump and the hydraulic cylinder change with time t in the embodiment.

The horizontal axis in FIGS. 4 and 6 is time t. FIG. 4 illustrates an example of the results obtained for the second merging and splitting valve according to the comparative example and FIG. 6 illustrates an example of the results obtained for the second merging and splitting valve 68 according to the embodiment. As illustrated in FIG. 5, the second merging and splitting valve according to the comparative example has a configuration in which a throttle S is provided in the passage Tf, the passage Ts, and the passage Tt in the intermediate position PI.

The pressure Ppf is the pressure of the operating oil discharged from the first hydraulic pump 31 and the pressure Pps is the pressure of the operating oil discharged from the second hydraulic pump 32. The pressure PLf is the largest LS pressure applied to the servo mechanism 31B of the first hydraulic pump 31 and the pressure PLs is the largest LS pressure applied to the servo mechanism 32B of the second hydraulic pump 32. The flow rate Qpf is the flow rate of the operating oil discharged from the first hydraulic pump 31 and the flow rate Qps is the flow rate of the operating oil discharged from the second hydraulic pump 32. The flow rate Qam is the flow rate of the operating oil supplied to the arm cylinder 22 and the flow rate Qbm is the flow rate of the operating oil supplied to the boom cylinder 23.

FIGS. 4 and 6 illustrate an example in which the state changes from a splitting state STS to a merging state STJ via an intermediate state STI over time t. In the comparative example, when the second merging and splitting valve 68*c* is at the splitting position PS (that is, the splitting state STS), since the connection port c and the connection port d are connected, the connection port c and the connection port d are at the same pressure. The largest LS pressure (that is, the pressure PLf) applied to the servo mechanism 31B of the first hydraulic pump 31 is stabilized to approximately the same pressure as the pressure corresponding to the load of the hydraulic cylinder 20 belonging to the first actuator group.

When the second merging and splitting valve 68*c* is at the intermediate position PI (that is, the intermediate state STI), the oil passage Tf that connects the connection port a and the connection port c is open slightly. In the second merging and splitting valve 68*c*, since the throttle S is provided in the oil passage Tt that connects the oil passage Tf and the oil passage Ts, the pressure (that is, the pressure PLf) of the high pressure-side connection port c decreases approaching the pressure of the low pressure-side connection port a. At the time point at which the pressure PLf decreases, since the pressure Ppf of the operating oil discharged from the first hydraulic pump 31 rarely changes, the pressure difference between the pressure PLs and the pressure PLf in the intermediate state STI is larger than the pressure difference between the pressure PLs and the pressure PLf in the splitting state STS. As a result, since the servo mechanism 31B operates the swash plate 31 in a direction of decreasing the flow rate Qpf of the operating oil discharged from the first hydraulic pump 31, the flow rate Qpf decreases. When the flow rate Qpf decreases, since the flow rate Qam of the operating oil supplied to the hydraulic cylinder 20 (in this example, the arm cylinder 22) belonging to the first actuator group decreases and the speed of the arm cylinder 22 decreases abruptly, an impact occurs in the excavator 100. As described above, when the second merging and splitting valve 68*c* of the comparative example switches from the splitting state STS to the merging state STJ via the intermediate state STI, an impact occurs in the excavator 100.

Although the second merging and splitting valve 68 of the embodiment is the same as the second merging and splitting valve 68*c* of the comparative example in the splitting state STS, the behavior of the pressure of the connection port c when the second merging and splitting valve 68 is at the intermediate position PI (that is, the intermediate state STI) is different. That is, in the second merging and splitting valve 68, since the throttle S is not provided in the oil passage Tt that connects the connection port c and the connection port d, when the second merging and splitting valve 68 is at the intermediate position PI, even when the oil passage TF that connects the connection port a and the connection port c is open slightly, the pressure of the connection port c has approximately the same magnitude as the pressure of the connection port d. Due to this, even when the second merging and splitting valve 68 switches from the splitting state STS to the intermediate state STI, the pressure (that is, the pressure PLf) of the connection port c rarely decreases.

Since the pressure Ppf of the operating oil discharged from the first hydraulic pump 31 rarely changes, the pressure difference between the pressure PLs and the pressure PLf in the intermediate state STI has substantially the same magnitude as the pressure difference between the pressure PLs and the pressure PLf in the splitting state STS. Due to this, since the amount of operation of the swash plate 31 in the direction of decreasing the flow rate Qpf of the operating oil discharged from the first hydraulic pump 31 is smaller than that of the second merging and splitting valve 68*c* of the comparative example, a decrease in the flow rate Qpf is suppressed. When a decrease in the flow rate Qpf is suppressed, since a decrease in the flow rate Qam of the operating oil supplied to the arm cylinder 22 is suppressed, an abrupt change in the speed of the arm cylinder 22 is also suppressed. As a result, an impact occurring in the excavator 100 is also suppressed. As described above, when the second merging and splitting valve 68 of the embodiment switches from the splitting state STS to the merging state STJ via the intermediate state STI, it is possible to suppress an impact occurring in the excavator 100.

[Pressure Sensor]

A pressure sensor 81C is attached to the first bucket passage 21A. A pressure sensor 81L is attached to the second bucket passage 21B. The pressure sensor 81C detects the pressure inside the cap-side space 21C of the bucket cylinder 21. The pressure sensor 81L detects the pressure inside the rod-side space 21L of the bucket cylinder 21.

A pressure sensor 82C is attached to the first arm passage 22A. A pressure sensor 82L is attached to the second arm passage 22B. The pressure sensor 82C detects the pressure inside the cap-side space 22C of the arm cylinder 22. The pressure sensor 82L detects the pressure inside the rod-side space 22L of the arm cylinder 22.

A pressure sensor 83C is attached to the first boom passage 23A. A pressure sensor 83L is attached to the second boom passage 23B. The pressure sensor 83C detects the pressure inside the cap-side space 23C of the boom cylinder 23. The pressure sensor 83L detects the pressure inside the rod-side space 21L of the boom cylinder 23.

A pressure sensor 84 is attached to a discharge port side of the first hydraulic pump 31 (specifically, between the first hydraulic pump 31 and the first pump passage 41). The pressure sensor 84 detects the pressure of the operating oil discharged from the first hydraulic pump 31. A pressure sensor 85 is attached to a discharge port side of the second hydraulic pump 32 (specifically, between the second hydraulic pump 32 and the second pump passage 42). The pressure sensor 85 detects the pressure of the operating oil discharged from the second hydraulic pump 32. The detection values detected by the respective pressure sensors 81C, 81L, 82C, 82L, 83C, 83L, 84, and 85 are output to the pump controller 19.

[Pressure Compensation Valve 70]

The hydraulic circuit 40 has a pressure compensation valve 70. The pressure compensation valve 70 includes a selection port for selecting a communication state, a throttled state, and a blocked state. The pressure compensation valve 70 includes a throttle valve capable of switching between a blocked state, a throttled state, and a communication state with its own pressure. The pressure compensation valve 70 aims to compensate for flow rate distribution according to the ratio of metering opening areas of respective shafts even when the load pressures of the respective shafts are different. When the pressure compensation valve 70 is not present, a greater part of the operating oil flows into the low load-side shaft. Since the pressure compensation valve 70 allows a pressure loss to act on the shaft having a low load pressure so that the outlet pressure of the main operating valve 60 of the shaft having a low load pressure is equal to the outlet pressure of the main operating valve 60 of the shaft having the largest load pressure, the outlet pressures of the respective main operating valves 60 become the same. Thus, the flow rate distribution function is realized.

The pressure compensation valve 70 includes a pressure compensation valve 71 and a pressure compensation valve 72 connected to the first main operating valve 61, a pressure compensation valve 73 and a pressure compensation valve 74 connected to the second main operating valve 62, and a pressure compensation valve 75 and a pressure compensation valve 76 connected to the third main operating valve 63.

The pressure compensation valve 71 compensates for a front-rear pressure difference (metering pressure difference) of the first main operating valve 61 in a state in which the first branch passage 47 and the first bucket passage 21A are connected so that operating oil is supplied to the cap-side space 21C. The pressure compensation valve 72 compensates for a front-rear pressure difference (metering pressure difference) of the first main operating valve 61 in a state in which the third branch passage 49 and the second bucket passage 21B are connected so that operating oil is supplied to the rod-side space 21L.

The pressure compensation valve 73 compensates for a front-rear pressure difference (metering pressure difference) of the second main operating valve 62 in a state in which the second branch passage 48 and the first arm passage 22A are connected so that operating oil is supplied to the rod-side space 22L. The pressure compensation valve 74 compensates for a front-rear pressure difference (metering pressure difference) of the second main operating valve 62 in a state in which the fourth branch passage 50 and the second arm passage 22B are connected so that operating oil is supplied to the cap-side space 22C.

The front-rear pressure difference (metering pressure difference) of the main operating valve means a difference between the pressure of an inlet port corresponding to the hydraulic pump side of the main operating valve and the pressure of an outlet port corresponding to the hydraulic cylinder side and is a pressure difference for metering the flow rate.

Due to the pressure compensation valve 70, even when a light load acts on one set of hydraulic cylinders 20 of the bucket cylinder 21 and the arm cylinder 22 and a heavy load acts on the other set of hydraulic cylinders 20, the operating oil can be distributed to the bucket cylinder 21 and the arm cylinder 22 with the flow rate corresponding to the operation amount of the operating device 5.

The pressure compensation valve 70 can supply a flow rate based on an operation regardless of the loads of the plurality of hydraulic cylinders 20. For example, when a heavy load acts on the bucket cylinder 21 and a light load acts on the arm cylinder 22, the pressure compensation valve 70 (73, 74) disposed on the light load side compensates for the metering pressure difference ΔP2 on the side of the arm cylinder 22 which is on the light load side so that the metering pressure difference ΔP2 on the side of the arm cylinder 22 which is on the light load side reaches approximately the same pressure as the metering pressure difference ΔP1 on the side of the bucket cylinder 21 and a flow rate based on the operation amount of the second main operating valve 62 is supplied when operating oil is supplied from the first main operating valve 61 to the bucket cylinder 21 and operating oil is supplied from the second main operating valve 62 to the arm cylinder 22 regardless of the generated metering pressure difference ΔP1.

When a heavy load acts on the arm cylinder 22 and a light load acts on the bucket cylinder 21, the pressure compensation valve 70 (71, 72) disposed on the light load side compensates for the metering pressure difference ΔP1 on the light load side so that a flow rate based on the operation amount of the first main operating valve 61 is supplied when operating oil is supplied from the second main operating valve 62 to the arm cylinder 22 and operating oil is supplied from the first main operating valve 61 to the bucket cylinder 21 regardless of the generated metering pressure difference ΔP2.

[Pump Controller 19]

Figure 7:
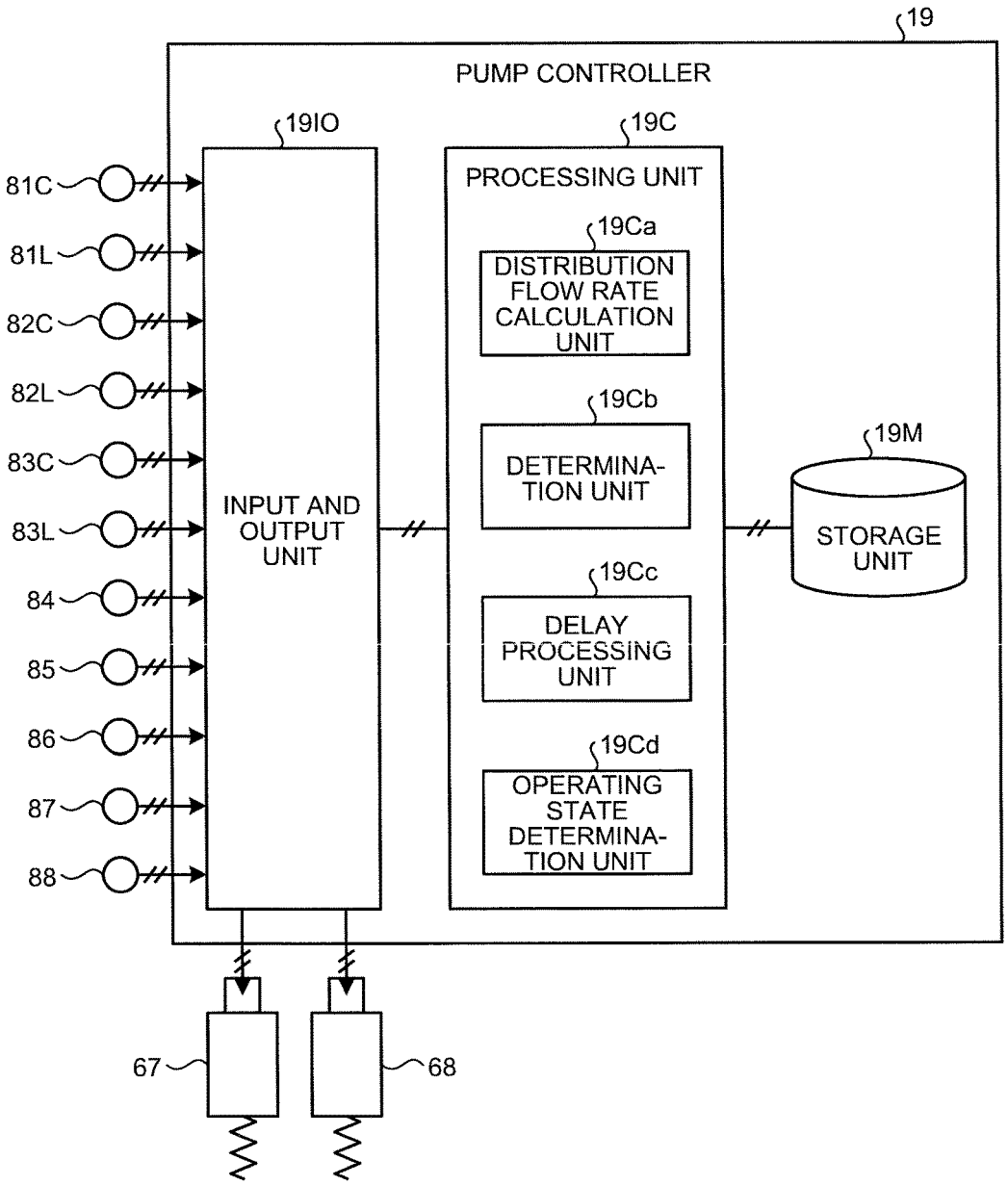
FIG. 7 is a functional block diagram of a pump controller according to an embodiment.

FIG. 7 is a functional block diagram of the pump controller 19 according to the embodiment. The pump controller 19 includes a processing unit 19C, a storage unit 19M, an input and output unit 19IO. The processing unit 19C is a processor, the storage unit 19M is a storage device, and the input and output unit 19IO is an input and output interface device. The processing unit 19C includes a distribution flow rate calculation unit 19Ca, a determination unit 19Cb, a delay processing unit 19Cc, and an operating state determination unit 19Cd. The storage unit 19M is also used as a temporary storage unit when the processing unit 19C executes processing.

The distribution flow rate calculation unit 19Ca calculates a distribution flow rate which is the flow rate of the operating oil distributed to each of the bucket cylinder 21, the arm cylinder 22, and the boom cylinder 23. The determination unit 19Cb determines whether the first merging and splitting valve 67 is to be open based on the distribution flow rate calculated by the distribution flow rate calculation unit 19Ca. When the distribution flow rate calculated by the distribution flow rate calculation unit 19Ca increases, the delay processing unit 19Cc calculates a corrected distribution flow rate obtained by performing a delay process on the distribution flow rate calculated by the distribution flow rate calculation unit 19Ca and supplies the corrected distribution flow rate to the determination unit 19Cb. The delay process is a process of decreasing an increase over time in the distribution flow rate calculated by the distribution flow rate calculation unit 19Ca. The operating state determination unit 19Cd determines an operating state of the working unit 1 using the input supplied to the operating device 5.

The processing unit 19C which is a processor reads a computer program for realizing the functions of the distribution flow rate calculation unit 19Ca, the determination unit 19Cb, the delay processing unit 19Cc, and the operating state determination unit 19Cd from the storage unit 19M and executes the computer program. With this process, the functions of the distribution flow rate calculation unit 19Ca, the determination unit 19Cb, the delay processing unit 19Cc, and the operating state determination unit 19Cd are realized. These functions may be realized by a single circuit, a complex circuit, a programmed processor, a parallel programmed processor, an application specific integrated circuit (ASIC), a field programmable gate array (FPGA), or a processing circuit in which these circuits or processors are combined.

The pressure sensors 81C, 81L, 82C, 82L, 83C, 83L, 84, 85, 86, 87, and 88, the first merging and splitting valve 67, and the second merging and splitting valve 68 are connected to the input and output unit 19IO. The pressure sensors 86, 87, and 88 are pressure sensors included in the operation amount detection unit 28. The pressure sensor 86 detects a pilot pressure when the input for operating the bucket 11 is supplied to the operating device 5. The pressure sensor 87 detects a pilot pressure when the input for operating the arm 12 is supplied to the operating device 5. The pressure sensor 88 detects a pilot pressure when the input for operating the boom 13 is supplied to the operating device 5.

The pump controller 19 (specifically, the processing unit 19C) acquires the detection values of the pressure sensors 81C, 81L, 82C, 82L, 83C, 83L, 84, 85, 86, 87, and 88 from the input and output unit 19IO and uses the detection values for the control of switching between the splitting state and the merging state. The control of switching between the splitting state and the merging state is control of operating at least the first merging and splitting valve 67 and further includes control of operating the second merging and splitting valve 68. Next, control of opening and closing the first merging and splitting valve 67 will be described.

[Control of Operating First Merging and Splitting Valve 67]

The pump controller 19 obtains the operating state of the working unit 1 based on the detection values of the pressure sensors 86, 87, and 88 of the operating device 5. Moreover, the pump controller 19 calculates a distribution flow rate of the operating oil distributed to each of the bucket cylinder 21, the arm cylinder 22, and the boom cylinder 23 from the detection values of the pressure sensors 81C, 81L, 82C, 82L, 83C, and 83L.

The pump controller 19 compares the calculated distribution flow rate with a threshold of the flow rate of the operating oil used when determining whether the first merging and splitting valve 67 is to be operated and closes the first merging and splitting valve 67 to create a splitting state when the distribution flow rate is equal to or smaller than the threshold. The pump controller 19 opens the first merging and splitting valve 67 to create a merging state when the calculated distribution flow rate is larger than the threshold. The threshold is determined based on the flow rate of the operating oil that can be supplied from one first hydraulic pump 31 or the flow rate of the operating oil that can be supplied from one second hydraulic pump 32.

When the distribution flow rate is Q, the distribution flow rate can be calculated by Equation (1). In Equation (1), Qd is a required flow rate, PP is the pressure of the operating oil discharged from the hydraulic pump 30, and ΔPA is a set pressure difference. In the embodiment, the first main operating valve 61, the second main operating valve 62, and the third main operating valve 63 are set so that a pressure difference between the inlet port and the outlet port is constant. This pressure difference is the set pressure difference ΔPA and is set in advance for each of the first main operating valve 61, the second main operating valve 62, and the third main operating valve 63 and stored in the storage unit 19M of the pump controller 19. Since the distribution flow rate Q depends mostly on the operating state of the working unit 5, Equation (1) includes the required flow rate Qd determined by the operating state of the working unit 1. As described above, since the distribution flow rate Q is calculated by taking the operating state of the working unit 5 into consideration, it is possible to switch between the splitting state and the merging state with high accuracy.

$$Q=Qd\times\sqrt{(PP/\Delta PL)} \tag{1}$$

The distribution flow rate may be calculated by Equation (2). In Example (2), LA is the load of the hydraulic cylinder 20. Since the load of the hydraulic cylinder 20 is taken into consideration, the accuracy of the distribution flow rate Q is improved. The load LA may be the actual load of the hydraulic cylinder 20, may be a predetermined constant, and may be 0. When the load L is 0, Equation (2) becomes Equation (1).

$$Q=Qd\times\sqrt{\{(PP-LA)/\Delta PL\}} \tag{2}$$

The distribution flow rate Q is calculated for the respective hydraulic cylinders 20 (that is, the bucket cylinder 21, the arm cylinder 22, and the boom cylinder 23). When Qbk is the distribution flow rate of the bucket cylinder 21, Qa is the distribution flow rate of the arm cylinder 22, and Qb is the distribution flow rate of the boom cylinder 23, the distribution flow rates Qbk, Qa, and Qb are calculated by Equations (3) to (5).

$$Qbk=Qdbk\times\sqrt{\{(PP-LAbk)/\Delta PL\}} \tag{3}$$

$$Qa=Qda\times\sqrt{\{(PP-LAa)/\Delta PL\}} \tag{4}$$

$$Qb=Qdb\times\sqrt{\{(PP-LAb)/\Delta PL\}} \tag{5}$$

In Equation (2), Qdbk is the required flow rate of the bucket cylinder 21 and LAbk is the load of the bucket cylinder 21. In Equation (3), Qda is the required flow rate of the arm cylinder 22 and LAa is the load of the arm cylinder 22. In Equation (4), Qdb is the required flow rate of the boom cylinder 23 and LAb is the load of the boom cylinder 23. The same value is used as the set pressure difference ΔPL for the first main operating valve 61 that supplies operating oil to the bucket cylinder 21, the second main operating valve 62 that supplies operating oil to the arm cylinder 22, and the third main operating valve 63 that supplies operating oil to the boom cylinder 23. As described above, the load LAbk, the load LAa, and the load LAb may be a constant or 0. In this case, the distribution flow rate Q is determined based on the required flow rate Qd (that is, the operating state of the working unit 5). When the load LAbk, the load LAa, and the load LAb are the actual loads of the bucket cylinder 21, the arm cylinder 22, and the boom cylinder 23, the distribution flow rate Q is determined based on the operating state of the working unit 5 and the load of the hydraulic cylinder 20.

The required flow rates Qdbk, Qda, and Qdb are calculated based on the pilot pressures detected by the pressure sensors 86, 87, and 88 included in the operation amount detection unit 28 of the operating device 5. The pilot pressures detected by the pressure sensors 86, 87, and 88 correspond to the operating state of the working unit 1. The distribution flow rate calculation unit 19Ca converts the pilot pressure to a spool stroke of the main operating valve 60 and calculates the required flow rates Qdbk, Qda, and Qdb from the obtained spool stroke. The relation between the pilot pressure and the spool stroke of the main operating valve 60 and the relation between the spool stroke of the main operating valve 60 and the required flow rates Qdbk, Qda, and Qdb are described in a conversion table. The conversion table is stored in the storage unit 19M. In this way, the required flow rates Qdbk, Qda, and Qdb are calculated based on the operating state of the working unit 1.

The distribution flow rate calculation unit 19Ca acquires the direction control valve of the pressure sensor 86 that detects the pilot pressure corresponding to the operation of the bucket 11 and converts the direction control valve to a spool stroke of the first main operating valve 61. Moreover, the distribution flow rate calculation unit 19Ca calculates the required flow rate Qdbk of the bucket cylinder 21 from the obtained spool stroke.

The distribution flow rate calculation unit 19Ca acquires the direction control valve of the pressure sensor 87 that detects the pilot pressure corresponding to the operation of the arm 12 and converts the direction control valve to a spool stroke of the second main operating valve 62. Moreover, the distribution flow rate calculation unit 19Ca calculates the required flow rate Qda of the arm cylinder 22 from the obtained spool stroke.

The distribution flow rate calculation unit 19Ca acquires the direction control valve of the pressure sensor 88 that detects the pilot pressure corresponding to the operation of the boom 13 and converts the direction control valve to a spool stroke of the third main operating valve 63. Moreover, the distribution flow rate calculation unit 19Ca calculates the required flow rate Qdb of the boom cylinder 23 from the obtained spool stroke.

The operation directions of the bucket 11, the arm 12, and the boom 13 are different depending on the stroke directions of the first main operating valve 61, the second main operating valve 62, and the third main operating valve 63. The distribution flow rate calculation unit 19Ca selects any one of the pressures of the cap-side spaces 21C, 22C, and 23C and the pressures of the rod-side spaces 21L, 22L, and 23L to be used when calculating the load LA depending on the operation directions of the bucket 11, the arm 12, and the boom 13. For example, when the spool stroke is in the first direction, the distribution flow rate calculation unit 19Ca calculates the loads LAbk, LAa, and LAb using the detection values of the pressure sensors 81C, 82C, and 83C that detect the pressures of the cap-side spaces 21C, 22C, and 23C. When the spool stroke is in a second direction different from the first direction, the distribution flow rate calculation unit 19Ca calculates the loads LA, LAa, and LAb using the detection values of the pressure sensors 81L, 82L, and 83L that detect the pressures of the rod-side spaces 21L, 22L, and 23L. In the embodiment, the loads LA, LAa, and LAb are the pressure of the bucket cylinder 21, the pressure of the arm cylinder 22, and the pressure of the boom cylinder 23, respectively.

In Equations (1) to (5), the pressure PP of the operating oil discharged from the hydraulic pump 30 is unknown. The distribution flow rate calculation unit 19Ca applies an arbitrary initial flow rate, executes repeated numerical computations so that Equation (6) below converges, and operates the first merging and splitting valve 67 based on the distribution flow rates Qbk, Qa, and Qb when Equation (6) converges.

$$Qlp=Qbk+Qa+Qb \tag{6}$$

Qlp is a pump limit flow rate and is the smallest value among a pump maximum flow rate Qmax and a pump target flow rate Qt determined from the target outputs of the first hydraulic pump 31 and the second hydraulic pump 32. The pump maximum flow rate Qmax is a value obtained by subtracting the flow rate of the operating oil supplied to a hydraulic swing motor when the electric swing motor 25 is replaced with the hydraulic swing motor from the flow rate calculated from the indication value of the throttle dial 33. When the excavator 100 does not have the electric swing motor 25, the pump maximum flow rate Qmax is the flow rate calculated from the indication value of the throttle dial 33.

The target output of the first hydraulic pump 31 and the second hydraulic pump 32 is a value obtained by subtracting the output of an auxiliary machine of the excavator 100 from the target output of the engine 26. The pump target flow rate Qt is the flow rate obtained from the target output and the pump pressure of the first hydraulic pump 31 and the second hydraulic pump 32. Specifically, the pump pressure is the larger one of the pressure of the operating oil discharged from the first hydraulic pump 31 and the pressure of the operating oil discharged from the second hydraulic pump 32.

When the distribution flow rates Qbk, Qa, and Qb are obtained, the determination unit 19Cb of the pump controller 19 operates the first merging and splitting valve 67 based on a comparison result between the distribution flow rates Qbk, Qa, and Qb with a threshold. That is, the determination unit 19Cb creates a merging state or a splitting state based on a comparison result between the distribution flow rates Qbk, Qa, and Qb and the threshold. The threshold is determined based on the flow rate of the operating oil that one first hydraulic pump 31 can supply and the flow rate of the operating oil that one second hydraulic pump 32 can supply.

The flow rate (hereinafter appropriately referred to as a first supply flow rate Qsf) of the operating oil that one first hydraulic pump 31 can supply is calculated by multiplying the highest rotation speed of the engine 26 determined from the indication value of the throttle dial 33 with the maximum capacity of the first hydraulic pump 31. The flow rate (hereinafter appropriately referred to as a second supply flow rate Qss) of the operating oil that one second hydraulic pump 32 can supply is calculated by multiplying the highest rotation speed of the engine 26 determined from the indication value of the throttle dial 33 with the maximum capacity of the second hydraulic pump 32. The first hydraulic pump 31 and the second hydraulic pump 32 are directly connected to the output shaft of the engine 26, the rotation speed of the first hydraulic pump 31 and the second hydraulic pump 32 is the same as the rotation speed of the engine 26. In the embodiment, the threshold of the operating oil used when determining whether the first merging and splitting valve 67 is to be operated is the first supply flow rate Qsf and the second supply flow rate Qss.

The first hydraulic pump 31 supplies operating oil to the bucket cylinder 21 and the arm cylinder 22. Therefore, when the sum of the distribution flow rate Qbk of the bucket cylinder 21 and the distribution flow rate Qa of the arm cylinder 22 is equal to or smaller than the first supply flow rate Qsf, the first hydraulic pump 31 can independently supply operating oil to the bucket cylinder 21 and the arm cylinder 22. The second hydraulic pump 32 supplies operating oil to the boom cylinder 23. Therefore, when the distribution flow rate Qb of the boom cylinder 23 is equal to or smaller than the second supply flow rate Qss, the second hydraulic pump 32 can independently supply operating oil to the boom cylinder 23.

The determination unit 19Cb creates the splitting state when the sum of the distribution flow rate Qbk of the bucket cylinder 21 and the distribution flow rate Qa of the arm cylinder 22 is equal to or smaller than the first supply flow rate Qsf and the distribution flow rate Qb of the boom cylinder 23 is equal to or smaller than the second supply flow rate Qss. In this case, the determination unit 19Cb closes the first merging and splitting valve 67. The determination unit 19Cb creates the merging state when the sum of the distribution flow rate Qbk of the bucket cylinder 21 and the distribution flow rate Qa of the arm cylinder 22 is not equal to or smaller than the first supply flow rate Qsf or the distribution flow rate Qb of the boom cylinder 23 is not equal to or smaller than the second supply flow rate Qss. In this case, the determination unit 19Cb opens the first merging and splitting valve 67.

Figure 8:
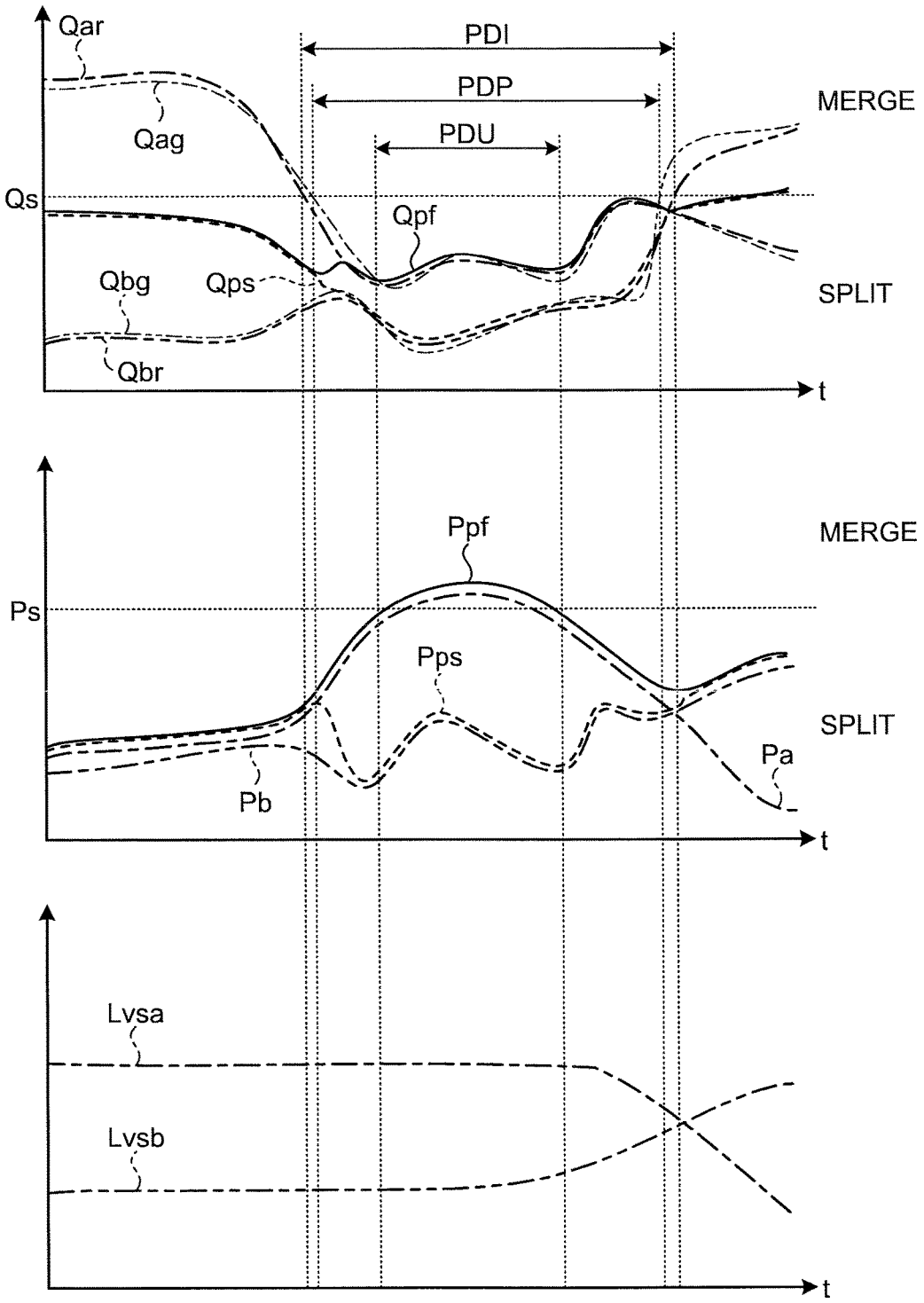
FIG. 8 is a diagram illustrating an example in which the flow rates of a hydraulic pump and a hydraulic cylinder, a discharge pressure of the hydraulic pump, and a lever stroke change with time.

FIG. 8 is a diagram illustrating an example in which the flow rates of the hydraulic pump and the hydraulic cylinder and the discharge pressure and the lever stroke of the hydraulic pump change with time t. The horizontal axis of FIG. 8 is time t. Qag is an estimated value of the flow rate of the operating oil supplied to the arm cylinder 22, Qbg is an estimated value of the flow rate of the operating oil supplied to the boom cylinder 23, Qar is a true value of the flow rate of the operating oil supplied to the arm cylinder 22, and Qbr is a true value of the flow rate of the operating oil supplied to the boom cylinder 23. The estimated value Qag is the distribution flow rate Qa of the arm cylinder 22, calculated by the pump controller 19, and the estimated value Qbg is the distribution flow rate Qb of the boom cylinder 23, calculated by the pump controller 19.

The flow rate Qpf is the flow rate of the operating oil discharged from the first hydraulic pump 31, and the flow rate Qps is the flow rate of the operating oil discharged from the second hydraulic pump 32. The pressure Ppf is the pressure of the operating oil discharged from the first hydraulic pump 31, and the pressure Pps of the pressure of the operating oil discharged from the second hydraulic pump 32. The pressure Pa is the pressure of the operating oil supplied to the arm cylinder 22, and the pressure Pb is the pressure of the operating oil supplied to the boom cylinder 23. The lever stroke Lvsa is the stroke of the operating lever when the operating device 5 is operated to operate the arm 12. The lever stroke Lvsb is the stroke of the operating lever when the operating device 5 is operated to operate the boom 13.

In the embodiment, the pump controller 19 calculates the distribution flow rate Q of the operating oil distributed to each hydraulic cylinder 20 based on the operating state of the working unit 1 and the load of the hydraulic cylinder 20 which is an actuator that drives the working unit 1. Moreover, the pump controller 19 switches the merging state and the splitting state based on the obtained distribution flow rate Q and the threshold Qs. In the embodiment, the splitting state can be created in the period PDP.

In contrast, a method of switching the merging state and the splitting state based on the pressure Ppf of the operating oil discharged from the first hydraulic pump 31 and the pressure Pps of the operating oil discharged from the second hydraulic pump 32 may be used. In this method, for example, when the pressures Ppf and Pps are equal to or larger than the threshold Ps, since the flow rate of the operating oil required for the hydraulic cylinder 20 decreases, the splitting state is created. When the pressures Ppf and Pps are smaller than the threshold Ps, since the flow rate of the operating oil required for the hydraulic cylinder 20 increases, the merging state is created. Since it is difficult to accurately estimate the flow rate of the operating oil supplied to the hydraulic cylinder 20 from the pressures Ppf and Pps, it is necessary to increase the threshold Ps. In this case, the splitting state can be created in the period PDU.

The period PDI in which the splitting state can be created is a period obtained based on the true values Qar and Qbr of the flow rate of the operating oil supplied to the hydraulic cylinder 20 and the threshold Qs. Although the true values Qar and Qbr of the flow rate of the operating oil supplied to the hydraulic cylinder 20 cannot be calculated actually, the period PDI based on the true values Qar and Qbr is the longest period that can be realized theoretically.

As can be understood from FIG. 8, the period in which the splitting state can be created increases in the order of the period PDU based on the pressures Ppf and Pps, the period PDP calculated by the control system 9 including the pump controller 19, and the period PDI based on the true values Qar and Qbr. In this way, the control system 9 can calculate the period PDP in which the splitting state can be created so as to approach the period that can be realized theoretically (that is, the period PDI based on the true values Qar and Qbr of the flow rate of the operating oil supplied to the hydraulic cylinder 20). As a result, since the control system 9 can increase the period in which the driving device 4 is operated in the splitting state, it is possible to increase the period in which a pressure loss when the high-pressure operating oil is decompressed in the merging state to supply the operating oil to the boom cylinder 23 can be reduced.

[Control of Operating Second Merging and Splitting Valve 68]

The second merging and splitting valve 68 has an intermediate position PI between the splitting position PS and the merging position PJ. The pump controller 19 (specifically, the determination unit 19Cb of the processing unit 19C) moves the second merging and splitting valve 68 from the splitting position PS to the intermediate position PI and then moves the same to the merging position PJ after temporarily holding the same at the intermediate position PI when switching from the splitting state to the merging state. With such control, the impact occurring in the excavator 100 when switching from the splitting state to the merging state is suppressed.

When the period in which the second merging and splitting valve 68 is held at the intermediate position PI increases too much, since the timing at which the merging and splitting valve is switched to the merging state is delayed, the flow rate of the operating oil supplied to the hydraulic cylinder 20 may be insufficient and a sufficient working performance may not be obtained. If the second merging and splitting valve 68*c* is switched from the splitting position PS to the intermediate position PI at an early timing, since the period of the splitting state decreases, the effect of reducing the pressure loss in the splitting state may decrease.

The determination unit 19Cb puts the first merging and splitting valve 67 in a closed state into an open state after the second merging and splitting valve 68 moves to the merging position PJ. In a state in which the second merging and splitting valve 68 is held at the intermediate position PI, when the pressure difference between the pressure of the operating oil discharged from the first hydraulic pump 31 and the pressure of the operating oil discharged from the second hydraulic pump 32 is equal to or smaller than a predetermined threshold, the pump controller stops holding the second merging and splitting valve 68 at the intermediate position PI and moves the same to the merging position PJ. The pump controller 19 opens the first merging and splitting valve 67 after moving the second merging and splitting valve 68 to the merging position PJ. With such control, since it is possible to secure a sufficient period in which the second merging and splitting valve 68 is at the intermediate position PI, it is possible to suppress the impact occurring in the excavator 100, increase the period of the splitting state and reduce a pressure loss.

Figure 9:
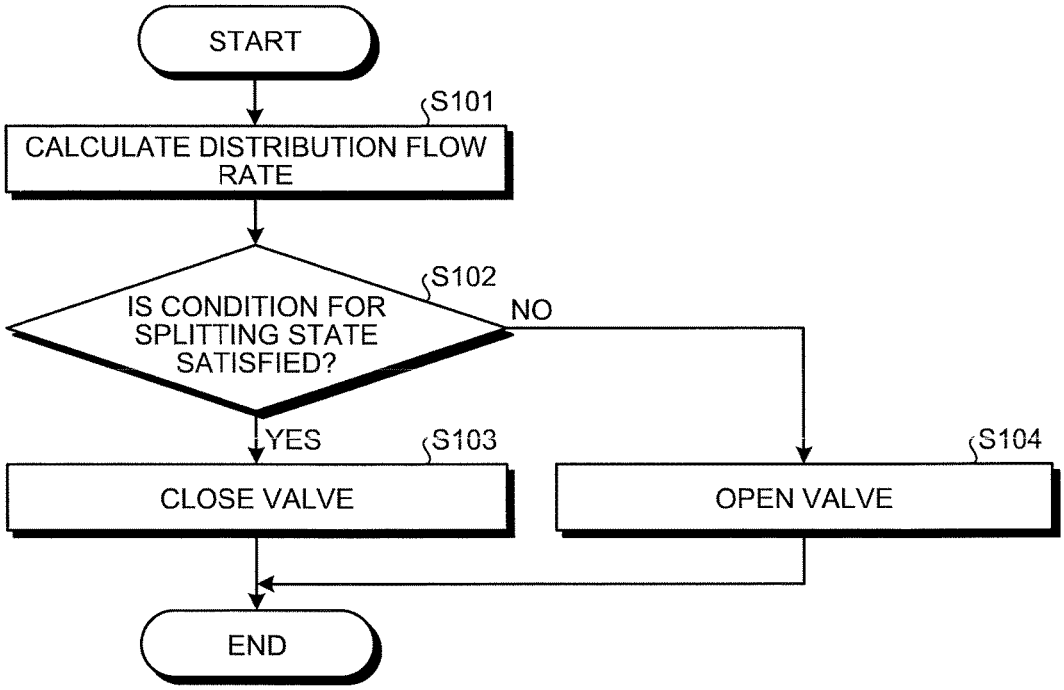
FIG. 9 is a flowchart illustrating an example of a control method according to the embodiment.

FIG. 9 is a flowchart illustrating an example of a control method according to the embodiment. A control method according to the embodiment involves calculating the distribution flow rate Q of the operating oil distributed to each hydraulic cylinder 20 based on the operating state of the working unit 1 and the load of the hydraulic cylinder 20 which is the actuator that drives the working unit 1 and switching the merging state and the splitting state based on the calculated distribution flow rate Q and the threshold. The control method is realized by the control system 9 (specifically, the pump controller 19).

In step S101, the distribution flow rate calculation unit 19Ca of the pump controller 19 calculates distribution flow rates Qbk, Qa, and Qb. In step S102, the determination unit 19Cb of the pump controller 19 determines whether a condition for creating the splitting state is satisfied. When the condition for creating the splitting state is satisfied (step S102: Yes), in step S103, the determination unit 19Cb closes the first merging and splitting valve 67 (step S103). With this process, the driving device 4 operates in the splitting state. When the condition for creating the splitting state is not satisfied (step S102: No), in step S104, the determination unit 19Cb opens the first merging and splitting valve 67 (step 104). With this process, the driving device 4 operates in the merging state.

When the condition for creating the splitting state is satisfied in step S102, the determination unit 19Cb of the pump controller 19 moves the second merging and splitting valve 68 from the splitting position PS to the intermediate position PI and temporarily holds the same at the splitting position PS in step S103. The determination unit 19Cb calculates a pressure difference between the pressure of the operating oil discharged from the first hydraulic pump 31 and the pressure of the operating oil discharged from the second hydraulic pump 32 from the direction control valve of the pressure sensor 84 and the pressure sensor of the pressure sensor 85. When the pressure difference is equal to or smaller than a predetermined threshold, the determination unit 19Cb stops holding the second merging and splitting valve 68*c* at the intermediate position PI and moves the second merging and splitting valve 68 to the merging position PJ. After that, the determination unit 19Cb closes the first merging and splitting valve 67.

[Process of Delay Processing Unit 19Cc]

The value of the distribution flow rate Q calculated by the distribution flow rate calculation unit 19Ca of the pump controller 19 tends to increase quicker than the true value Qr when the load varies. Due to this, when the first merging and splitting valve 67 is operated based on the distribution flow rate Q to switch the merging state and the splitting state, the merging state and the splitting state are switched frequently in a short period. As a result, the effect of reducing the pressure loss in the splitting state may decrease.

Figure 10:
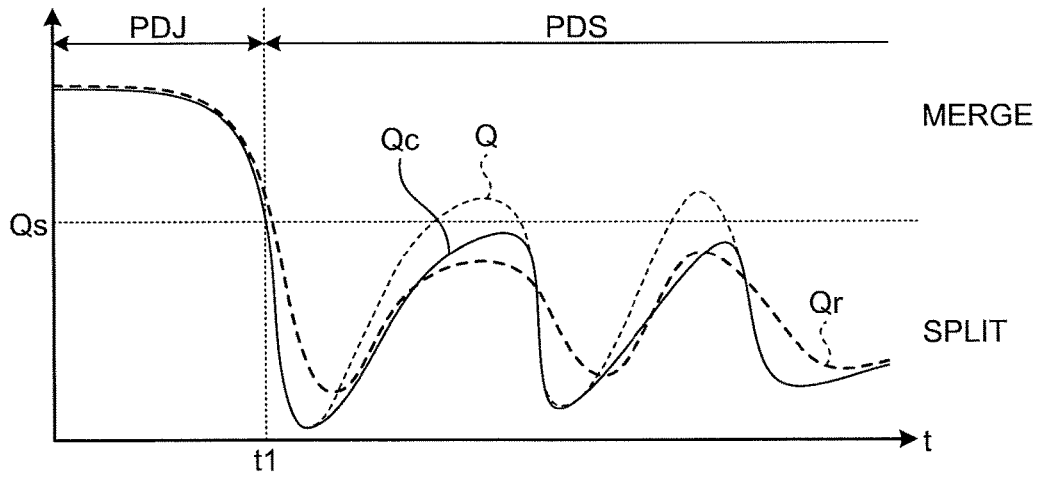
FIG. 10 is a diagram illustrating an example of a change over time in a distribution flow rate, a corrected distribution flow rate, and a true value of the flow rate of the operating oil supplied to the hydraulic cylinder.

FIG. 10 is a diagram illustrating an example of a change over time t in a distribution flow rate Q, a corrected distribution flow rate Qc, and a true value Qr of the actual flow rate of the operating oil supplied to the hydraulic cylinder 20. As illustrated in FIG. 10, in the period PDJ, the driving device 4 operates in the merging state. At the timing between the period PDJ and the period PDS, the driving device 4 operates in the splitting state. However, the value of the distribution flow rate Q changes quicker than the true value Qr and is calculated to be large particularly in a direction in which the flow rate increases. Therefore, a phenomenon in which the distribution flow rate Q becomes higher than the threshold Qs and then becomes lower than the threshold Qs in the period PDS occurs repeatedly. As a result, the merging state and the splitting state are switched frequently in a short period.

In order to obviate this phenomenon, when the obtained distribution flow rate Q increases with time t, the delay processing unit 19Cc of the pump controller 19 operates the first merging and splitting valve 67 using the corrected distribution flow rate Qc obtained by decreasing an increase over time t in the obtained distribution flow rate Q. Although the corrected distribution flow rate Qc is the distribution flow rate Q having passed through a low-pass filter, for example, the corrected distribution flow rate Qc may be obtained by decreasing the increase over time t in the distribution flow rate Q. For example, the corrected distribution flow rate Qc may be a value that the delay processing unit 19Cc outputs by delaying the distribution flow rate Q according to a first-order lag.

The determination unit 19Cb operates the first merging and splitting valve 67 using the corrected distribution flow rate Qc to switch between the merging state and the splitting state. With such a process, as illustrated in FIG. 10, since the increase over time t in the distribution flow rate Q decreases, even when the load of the hydraulic cylinder 20 varies frequently, the corrected distribution flow rate Qc is suppressed from increasing over the threshold Qs. As a result, since it is possible to prevent the splitting state from switching to the merging state frequently in a short period, the control system 9 can suppress a decrease in the effect of reducing the pressure loss in the splitting state.

In the embodiment, when the obtained distribution flow rate Q increase with time t, the pump controller 19 operates the first merging and splitting valve 67 using the corrected distribution flow rate Qc. The splitting state switches to the merging state when the distribution flow rate Q exceeds the threshold Qs, and the merging state switches to the splitting state when the distribution flow rate Q becomes equal to or smaller than the threshold Qs. The pump controller 19 can switch the splitting state to the merging state quickly by operating the first merging and splitting valve 67 when the obtained distribution flow rate Q increase with time t.

When the first merging and splitting valve 67 is operated using the corrected distribution flow rate Qc, the operation of the first merging and splitting valve 67 may be decelerated depending on the type of the work performed by the excavator 100. For example, when the work performed by the excavator 100 involves operating the working unit 1 at a high speed, the operation of the first merging and splitting valve 67 may be decelerated. An example of a case in which the working unit 1 is operated at a high speed is a case in which the working unit 1 performs a dumping operation. The work of operating the working unit 1 at a high speed is a work in which the flow rate supplied to the hydraulic cylinder 20 is large.

The pump controller 19 switches the use of a low-pass filter depending on the operating state of the working unit 1 when determining whether the first merging and splitting valve 67 will be operated. Specifically, the pump controller 19 switches whether the corrected distribution flow rate Qc is to be used or the distribution flow rate Q having not passed through the low-pass filter is to be used. With such a process, when it is necessary to operate the working unit 1 at a high speed, the determination unit 19Cb can operate the first merging and splitting valve 67 using the distribution flow rate Q and switch between the merging state and the splitting state. As a result, a decrease in the speed of the working unit 1 when it is necessary to operate the working unit 1 at a high speed is suppressed.

The operating state determination unit 19Cd of the pump controller 19 determines the operating state of the working unit 1 based on the pilot pressures detected by the pressure sensors 86, 87, and 88 included in the operation amount detection unit 28 that detects the operation amount of the operating device 5. When the operating state determination unit 19Cd determines that an operation of operating the working unit 1 at a high speed is performed from the pilot pressure, the determination unit 19Cb operates the first merging and splitting valve 67 using the distribution flow rate Q and switches between the merging state and the splitting state.

Figure 11:
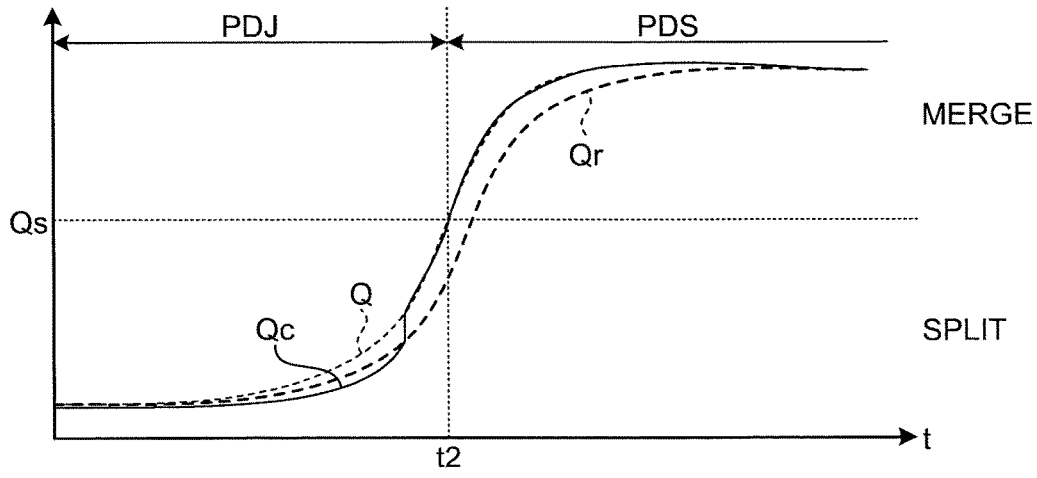
FIG. 11 is a diagram illustrating an example of a change over time in a distribution flow rate; a corrected distribution flow rate, and a true value of the flow rate of the operating oil supplied to the hydraulic cylinder.

FIG. 11 is a diagram illustrating an example of a change over time t in the distribution flow rate Q, the corrected distribution flow rate Qc, and the true value Qr of the flow rate of the operating oil supplied to the hydraulic cylinder 20. In the period PDJ, the driving device 4 operates in the splitting state. At the timing between the period PDJ and the period PDS, the driving device 4 operates in the merging state. When the corrected distribution flow rate Qc and the threshold Qs are compared and the operating state of the driving device 4 is switched from the splitting state to the merging state, the operating state can be switched to the merging state at a time point later than time t1. On the other hand, when the distribution flow rate Q and the threshold Qs are compared and the operating state of the driving device 4 is switched from the splitting state to the merging state, the operating state can be switched to the merging state at time t1. As a result, when the work of operating the working unit 1 at a high speed is performed, since the control system 9 can supply the operating oil of the flow rate required for the operation of the working unit 1 to the hydraulic cylinder 20 before the flow rate of the operating oil supplied to the hydraulic cylinder 20 becomes insufficient, a decrease in the speed of the working unit 1 is suppressed.

In the driving device 4 of the excavator 100, the electric swing motor 25 swings the upper swing structure 2. That is, the upper swing structure 2 is driven by an actuator which does not belong to the first actuator group and the second actuator group. When the upper swing structure 2 is swung by the electric swing motor 25 and the bucket cylinder 21 and the arm cylinder 22 are driven by the operating oil discharged from the first hydraulic pump 31, the occurrence of a pressure loss in the boom cylinder 23 is suppressed. Moreover, when a pressure compensation valve is provided to improve the operability of the operating device 5, a pressure loss resulting from the pressure compensation valve occurs. In the embodiment, operating oil is supplied from one hydraulic pump 30 (the second hydraulic pump 32) to the boom cylinder 23, and the upper swing structure 2 is swung by the electric swing motor 25. Due to this, a decrease in operability and the occurrence of a pressure loss are suppressed.

As described above, the control system 9 calculates the distribution flow rate of the operating oil distributed to each actuator (that is, each hydraulic cylinder 20) based on the operating state of the working unit 1. Moreover, the control system 9 switches between a first state in which the operating oils supplied from both the first hydraulic pump 31 and the second hydraulic pump 32 are supplied to the plurality of hydraulic cylinders 20 and a second state in which the hydraulic cylinder 20 to which operating oil is supplied from the first hydraulic pump 31 is different from the hydraulic cylinder 20 to which operating oil is supplied from the second hydraulic pump 32 based on the obtained distribution flow rate. With such a process, the control system 9 can extend a range in which the operating oil discharged from a plurality of hydraulic pump is split and supplied to the actuator when the operating oil is supplied from the plurality of hydraulic pumps to the actuator. That is, since the control system 9 can extend a period in which the driving device 4 is operated in the second state, a period in which the high-pressure operating oil in the first state is decompressed to reduce a pressure loss when supplying the operating oil to the boom cylinder 23 increases.

The control system 9 can improve the accuracy of the distribution flow rate by calculating the distribution flow rate based on the operating state of the working unit 1 and the load of the actuator. As a result, the threshold of the flow rate of the operating oil used when determining whether the first merging and splitting valve 67 which is an opening and closing device is to be operated can be controlled so as to approach a theoretical value. Due to this, the control system 9 can extend a period in which the driving device 4 is operated in the second state and extend a period in which the high-pressure operating oil in the first state is decompressed to reduce a pressure loss when supplying the operating oil to the boom cylinder 23.

In the embodiment, the driving device 4 (the hydraulic circuit 40) is applied to the excavator 100. A target to which the driving device 4 is applied is not limited to the excavator but can be broadly applied to a hydraulic work machine other than the excavator.

In the embodiment, although the excavator 100 which is a work machine is a hybrid work machine, the work machine may not be a hybrid work machine. In the embodiment, although the first hydraulic pump 31 and the second hydraulic pump 32 are swash plate-type pumps, the hydraulic pumps are not limited to this. In the embodiment, although the loads LA, LAa, and LAb are the pressure of the bucket cylinder 21, the pressure of the arm cylinder 22, and the pressure of the boom cylinder 23, the present invention is not limited to this. For example, the pressure of the bucket cylinder 21, the pressure of the arm cylinder 22, and the pressure of the boom cylinder 23 corrected by an area ratio or the like of the throttle valves of the pressure compensation valves 71 to 76 may be the loads LA, LAa, and LAb.

In the embodiment, although the threshold Qs used when determining whether the first merging and splitting valve 67 is to be operated is the first supply flow rate Qsf and the second supply flow rate Qss, the present invention is not limited to this. For example, a flow rate smaller than the first supply flow rate Qsf and the second supply flow rate Qss may be the threshold Qs. In the embodiment, although the pump controller 19 includes the delay processing unit 19Cc and the operating state determination unit 19Cd, the pump controller 19 may not include any one of the delay processing unit 19Cc and the operating state determination unit 19Cd and may not include the operating state determination unit 19Cd.

In the embodiment, although the first state and the second state are switched by operating the first merging and splitting valve 67, the switching between the first state and the second state may not be realized by the operation of the first merging and splitting valve 67. In the embodiment, although the elements of the working unit 1 include the bucket 8, the arm 7, and the boom 6, the elements of the working unit 1 are not limited to these elements.

While the embodiment has been described, the embodiment is not limited to the above-described content. Moreover, the above-described constituent elements include those that can be easily conceived by those skilled in the art, those that are substantially the same as the constituent elements, and those in the range of so-called equivalents. Further, the above-described constituent elements can be appropriately combined with each other. Furthermore, at least one of various omissions, substitutions, or changes in the constituent elements can be made without departing from the spirit of the embodiment.

REFERENCE SIGNS LIST

1 WORKING UNIT
2 UPPER SWING STRUCTURE
3 LOWER TRAVELING STRUCTURE
4 DRIVING DEVICE
5 OPERATING DEVICE
9 CONTROL SYSTEM
11 BUCKET
12 ARM
13 BOOM
14 STORAGE BATTERY
17 HYBRID CONTROLLER
18 ENGINE CONTROLLER
19 PUMP CONTROLLER
19C PROCESSING UNIT
19M STORAGE UNIT
19Ca DISTRIBUTION FLOW RATE CALCULATION UNIT
19Cb DETERMINATION UNIT
19Cc DELAY PROCESSING UNIT
19Cd OPERATING STATE DETERMINATION UNIT
19IO INPUT AND OUTPUT UNIT
20 HYDRAULIC CYLINDER
21 BUCKET CYLINDER
22 ARM CYLINDER
23 BOOM CYLINDER
24 TRAVELING MOTOR
25 ELECTRIC SWING MOTOR
26 ENGINE
28 OPERATION AMOUNT DETECTION UNIT
29 COMMON RAIL CONTROL UNIT
30 HYDRAULIC PUMP
31 FIRST HYDRAULIC PUMP
32 SECOND HYDRAULIC PUMP
33 THROTTLE DIAL
40 HYDRAULIC CIRCUIT
55 MERGING PASSAGE
60 MAIN OPERATING VALVE
61 FIRST MAIN OPERATING VALVE
62 SECOND MAIN OPERATING VALVE
63 THIRD MAIN OPERATING VALVE
67 FIRST MERGING AND SPLITTING VALVE
68 SECOND MERGING AND SPLITTING VALVE
81C, 81L, 82C, 82L, 83C, 83L, 84, 85, 86, 87, 88 PRESSURE SENSOR
100 EXCAVATOR (WORK MACHINE)
LA, LAa, LAb, LAbk LOAD
Q, Qa, Qb, Qbk DISTRIBUTION FLOW RATE
Qs THRESHOLD

The invention claimed is:

1. A control system for controlling a work machine including a working unit including a plurality of elements and a plurality of actuators that drives the plurality of elements, comprising:

a first hydraulic pump and a second hydraulic pump each of which supplies operating oil to at least one of the actuators;

a control device that calculates a distribution flow rate of operating oil distributed to each of the actuators based on an operating state of the working unit and switches, based on the calculated distribution flow rate, between a first state in which the operating oil supplied from both the first hydraulic pump and the second hydraulic pump is supplied to the actuators and a second state in which the actuator to which the operating oil is supplied from the first hydraulic pump is different from the actuator to which the operating oil is supplied from the second hydraulic pump, a passage that connects the first hydraulic pump and the second hydraulic pump; and an opening and closing device that is provided in the passage to open and close the passage, wherein in a state in which the passage is closed, the first hydraulic pump supplies operating oil to a first actuator group to which at least one of the actuators belongs, and the second hydraulic pump supplies operating oil to a second actuator group to which at least one of the actuators different from the actuator belonging to the first actuator group belongs, the control device switches between the first state and the second state by operating the opening and closing device based on the distribution flow rate, and when the calculated distribution flow rate increases with time, the control device operates the opening and closing device using a corrected distribution flow rate obtained by decreasing an increase over time in the calculated distribution flow rate.

2. The control system according to claim 1, wherein the control device calculates the distribution flow rate based on the operating state of the working unit and a load of the actuator.

3. The control system according to claim 1, wherein the control device operates the opening and closing device based on a comparison result between the distribution flow rate and a threshold determined based on a flow rate of operating oil that one first hydraulic pump can supply and a flow rate of operating oil that one second hydraulic pump can supply.

4. The control system according to claim 1, wherein when determining whether the opening and closing device is to be operated, the control device switches whether the corrected distribution flow rate or the distribution flow rate is to be used depending on the operating state.

5. The control system according to claim 1, wherein the plurality of elements includes a bucket, an arm connected to the bucket, and a boom connected to the arm, the plurality of actuators includes a bucket cylinder that operates the bucket, an arm cylinder that operates the arm, and a boom cylinder that operates the boom, and the bucket cylinder and the arm cylinder belong to the first actuator group, and the boom cylinder belongs to the second actuator group.

6. The control system according to claim 1, wherein the work machine has a swing structure that supports the working unit, and the swing structure is driven by an actuator that does not belong to the first actuator group and the second actuator group.

7. The control system according to claim 1, further comprising:

a first detector that detects a largest load pressure of the actuators that belong to the first actuator group;

a first oil passage that guides the largest load pressure detected by the first detector to a first hydraulic pump control device that operates the first hydraulic pump;

a second detector that detects a largest load pressure of the actuators that belong to the second actuator group;

a second oil passage that guides the largest load pressure detected by the second detector to a second hydraulic pump control device that operates the second hydraulic pump; and a switching valve that switches between a connection and a disconnection of the first detector and the second detector and switches between a connection and a disconnection of the first oil passage and the second oil passage, wherein in an intermediate state between the connection and the disconnection, the switching valve connects the first detector and the first oil passage in a state in which no throttle is provided, connects the first detector and the second detector in a state in which a throttle is provided, and connects the first oil passage and the second oil passage in a state in which a throttle is provided.

8. The control system according to claim 7, wherein the control device holds the switching valve in the intermediate state after the control device switches the switching valve from the disconnection state to the intermediate state, when a pressure difference between a pressure of the operating oil discharged from the first hydraulic pump and a pressure of the operating oil discharged from the second hydraulic pump is equal to or smaller than a predetermined threshold, the control device stops holding the switching valve in the intermediate state and changes the switching valve to the connection state, and the control device opens the opening and closing device after the switching valve enters into the connection state.

9. A work machine comprising the control system according to claim 1.

10. A control method of controlling a work machine including a first hydraulic pump and a second hydraulic pump each of which supplies operating oil to at least one of a plurality of actuators that drives a plurality of elements that form the working unit, a control device, a passage that connects the first hydraulic pump and the second hydraulic pump; and an opening and closing device that is provided in the passage to open and close the passage, the control method comprising:

calculating a distribution flow rate of the operating oil distributed to each of the actuators based on an operating state of the working unit; and switching, based on the calculated distribution flow rate, between a first state in which the operating oil supplied from both the first hydraulic pump and the second hydraulic pump is supplied to the actuators and a second state in which the actuator to which the operating oil is supplied from the first hydraulic pump is different from the actuator to which the operating oil is supplied from the second hydraulic pump, in a state in which the passage is closed, supplying, by the first hydraulic pump, operating oil to a first actuator group to which at least one of the actuators belongs, and supplying, by the second hydraulic pump, operating oil to a second actuator group to which at least one of the actuators different from the actuator belonging to the first actuator group belongs, switching, by the control device, between the first state and the second state by operating the opening and closing device based on the distribution flow rate, and when the calculated distribution flow rate increases with time, operating, by the control device, the opening and closing device using a corrected distribution flow rate obtained by decreasing an increase over time in the calculated distribution flow rate.

* * * * *